US008777767B2

(12) United States Patent
Kopp et al.

(10) Patent No.: US 8,777,767 B2
(45) Date of Patent: Jul. 15, 2014

(54) HYBRID PLAY SET

(75) Inventors: Robert G. Kopp, Elburn, IL (US); Michael R. Vogler, Oswego, IL (US); Torrence Anderson, Overland Park, KS (US)

(73) Assignee: Suncast Technologies, LLC, Palm Beach Gardens, FL (US)

( * ) Notice: Subject to any disclaimer, the term of this patent is extended or adjusted under 35 U.S.C. 154(b) by 130 days.

(21) Appl. No.: 13/343,760

(22) Filed: Jan. 5, 2012

(65) Prior Publication Data

US 2013/0178299 A1 Jul. 11, 2013

(51) Int. Cl.
*A63G 31/00* (2006.01)

(52) U.S. Cl.
USPC ..... 472/136

(58) Field of Classification Search
USPC ..... 472/136; 482/35
See application file for complete search history.

(56) References Cited

U.S. PATENT DOCUMENTS

| | | | | |
|---|---|---|---|---|
| 4,262,900 | A | 4/1981 | Vinson | |
| 4,796,884 | A | 1/1989 | Ely et al. | |
| D344,773 | S * | 3/1994 | Aker et al. | D21/818 |
| 5,496,232 | A * | 3/1996 | Morris et al. | 482/35 |
| 5,715,642 | A * | 2/1998 | Buers | 52/633 |
| 6,099,411 | A * | 8/2000 | Van Wagenen | 472/136 |
| 2002/0010030 | A1 * | 1/2002 | Zeilinger | 472/117 |
| 2008/0051257 | A1 | 2/2008 | Hamblin et al. | |

* cited by examiner

*Primary Examiner* — Michael Dennis
(74) *Attorney, Agent, or Firm* — McHale & Slavin, P.A.

(57) ABSTRACT

A hybrid play set is disclosed which includes twin towers. Each of the towers includes at least two levels. A play house and an enclosed area can be provided within one tower. A sand box, a ladder, a slide and a climbing wall can be provided within the other tower. A swing set is also secured to one side of one of the towers. The components from which the play set is made can be plow molded plastic, wood or a composite of blow molded plastic and wood/metal reinforcement.

19 Claims, 50 Drawing Sheets

HYBRID PLAY SET

FIELD OF THE INVENTION

The present invention relates generally to play equipment. In particular, the present invention relates to play equipment which includes swings, slides, climbing areas, and elevated play houses. The present invention is constructed and arranged to be assembled by one or more individuals and placed adjacent an individual's home or in a communal playground area.

DESCRIPTION OF THE PRIOR ART

U.S. Pat. No. 4,262,900 issued to Vinson discloses an elevated playhouse in combination with one or more swings, a set of gymnastic bars, a see-saw, parallel bars, a slide, a basket for basketball, a firemen's pole, a ladder for climbing into the playhouse, and a trapdoor for entering the playhouse.

U.S. Pat. No. 4,796,884 issued to Ely et al. discloses a play set including a playhouse and a swing set. A lift system secured to the playhouse and swing set permit both structures to be raised to accommodate larger children.

U.S. Published Patent Application No. 2008/0051257 filed by Hamblin et al. discloses a platform and attached swing set. The swing set can include swings, bars, and rings. The platform can include a slide, a climbing wall, a ladder, and a tent. Monkey bars, a picnic table, and a sandbox can also be secured to the platform. A unique three person swing can also be secured to the structure.

What is needed in the art is a play set having a wood like finish that prevents splinters and injury from rough wood surfaces. Also a play set which can readily be assembled from sub-assembles that include walls, floors, roofs, and gables. The play set should have a durable finish that resists fading from weathering. The play set should be made from blow molded plastic components that are relatively light weight to aid in assembly of the play set and shipping of the play set. The play set should also include integrated attachments and tabs to secure the components together without the use of fasteners.

SUMMARY OF THE INVENTION

A hybrid play set is disclosed which includes twin towers. Each of the towers includes at least two levels. A play house and an enclosed area can be provided within one tower. A sand box, a ladder, a slide and a climbing wall can be provided within the other tower. A swing set is also secured to one side of one of the towers. The components from which the play set is made can be blow molded plastic, wood or a composite of blow molded plastic and wood/metal reinforcement.

Accordingly, it is an objective of the present invention to provide a play set made of plastic panels which are naturally weather resistant and will not crack or splinter due to outdoor exposure. The plastic panels also will not cause injuries to individuals that wood structures cause.

It is a further objective of the present invention to reduce the amount of assembly required to complete the play set. The blow molded components combine multiple separate components of conventional play sets. Further, the reduction of components reduces the number and complexity of the fasteners required for assembly.

It is yet another objective of the present invention to provide a wood sub-structure of the play set where it is needed for strength. The main posts, the base, and the floor framing are constructed of wood in order to retain its superior structural properties. The wood framing also allows for the use of common fasteners rather than specialty fasteners that would be required for an all-plastic or metal play set construction. The threaded retention properties of wood are taken advantage of throughout the play set and the screw locations are carefully pre-drilled to correct pilot hole diameters at the correct locations for proper alignment of the components.

It is a still further objective of the present invention to provide blow molded panels which provide added safety from impact injuries by having softer surface properties than what wood provides. The blow molded panels are inherently energy absorbing because they are hollow and the shell is preferably composed of flexible polyethylene material. The plastic blow molded panels provide good impact resistance and are more flexible that wood. Falling on or against a blow molded plastic panel would be less likely to cause serious injury.

It is a still further objective of the present invention to reduce the weight of the overall product by using blow molded plastic panels. The packaged product as delivered to a construction site has significantly more lightweight plastic and less heavier wood materials. The lighter weight panels will also place less load stress on the wood posts and framing. All-wood construction of walls, floors, roof, and gables requires a wood frame to carry significantly heavier static load. The lightweight plastic panels are easier to lift into place during assembly, requiring less lifting effort to assemble the panels to the framing.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
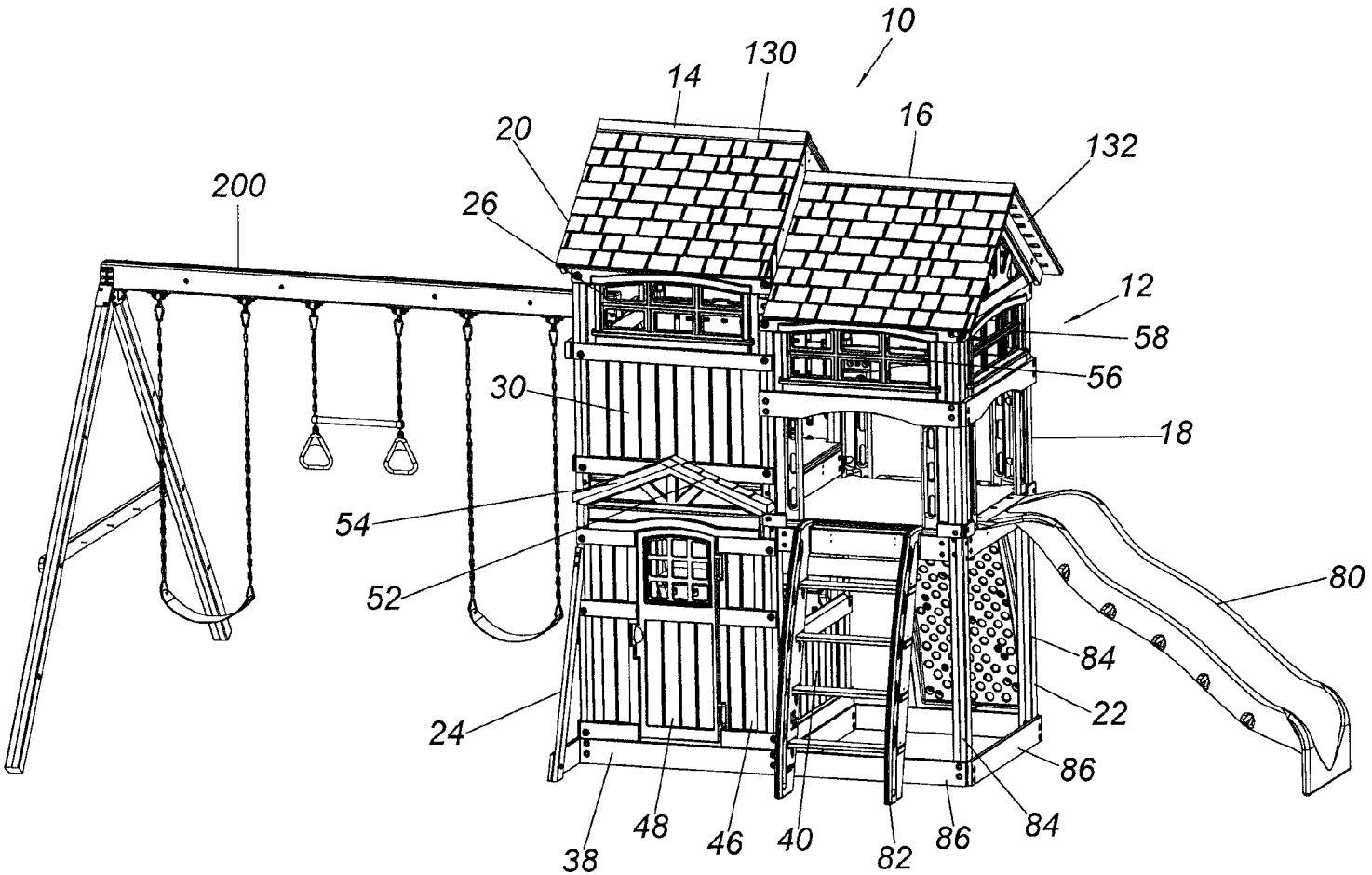
FIG. 1 is a front perspective view of the present invention.

While the present invention is susceptible of embodiment in various forms, there is shown in the drawings and will hereinafter be described a presently preferred, albeit not limiting, embodiment with the understanding that the present disclosure is to be considered an exemplification of the present invention and is not intended to limit the invention to the specific embodiments illustrated.

FIGS. 1-49, which are now referenced, illustrate the present invention and the manner in which it is assembled. While the present invention is for a play set or playground equipment, it should be understood that the principles of the present invention can be used in connection with other types of structures. Additionally, while the play set is illustrated in a preferred embodiment, the components can be rearranged into various other configurations. The play set can also be located on all types of natural or man made surfaces.

Figure 2:
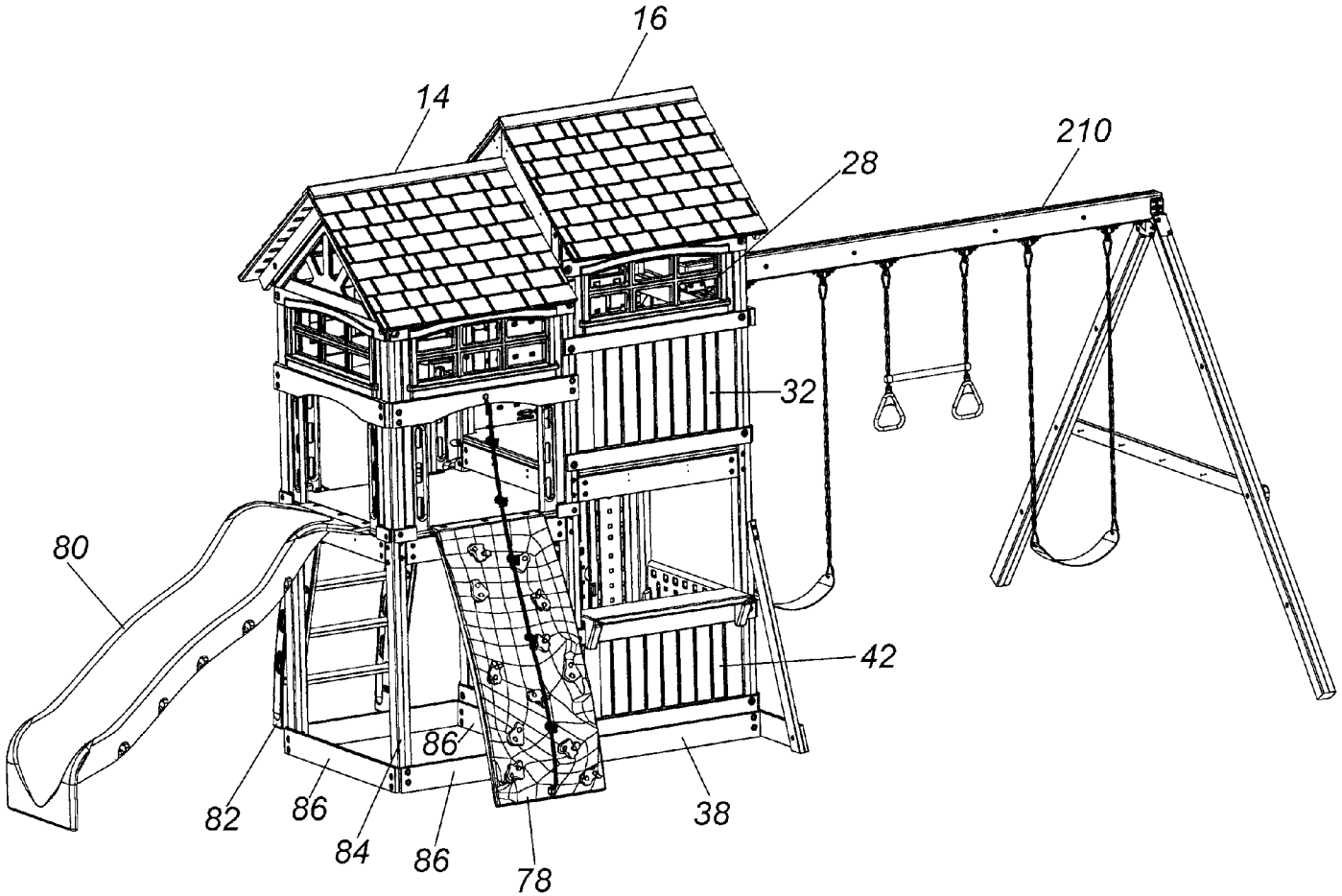
FIG. 2 is a rear perspective view of the present invention.
Figure 6:
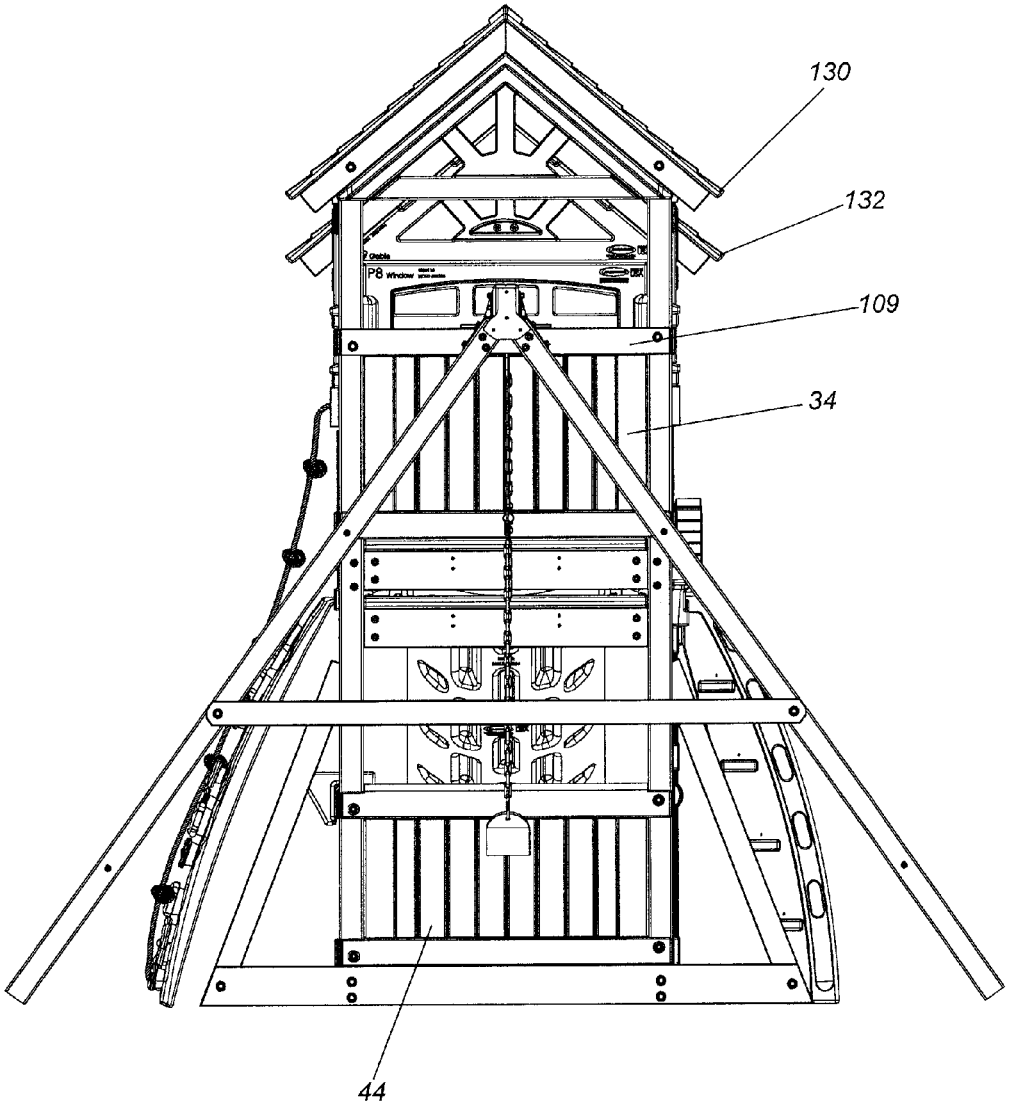
FIG. 6 is a left side view of the present invention.
Figure 7:
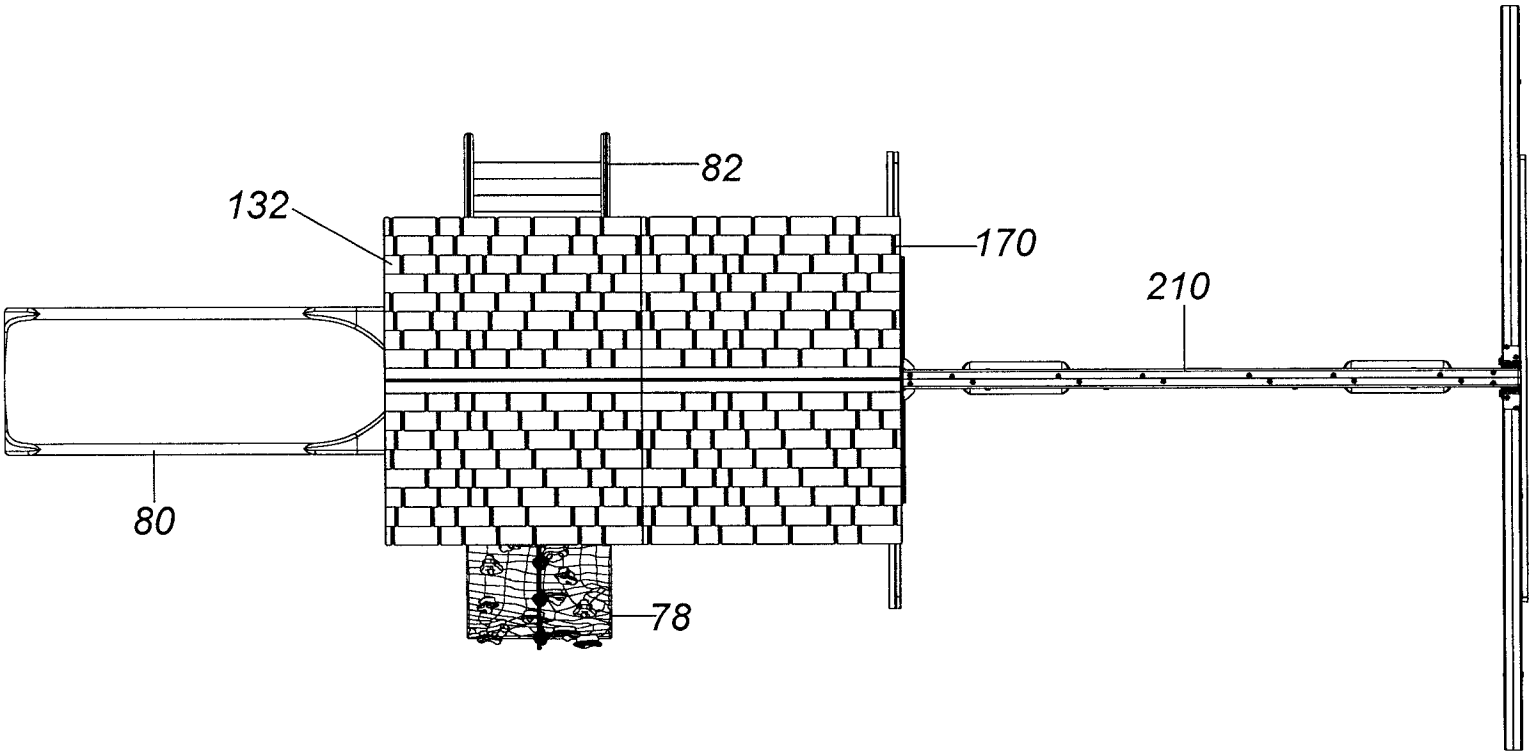
FIG. 7 is a top view of the present invention.
Figure 8A:
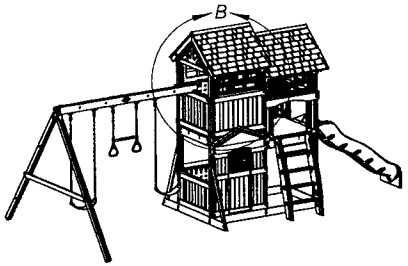
FIG. 8A is a front perspective view of the present invention.
Figure 8B:
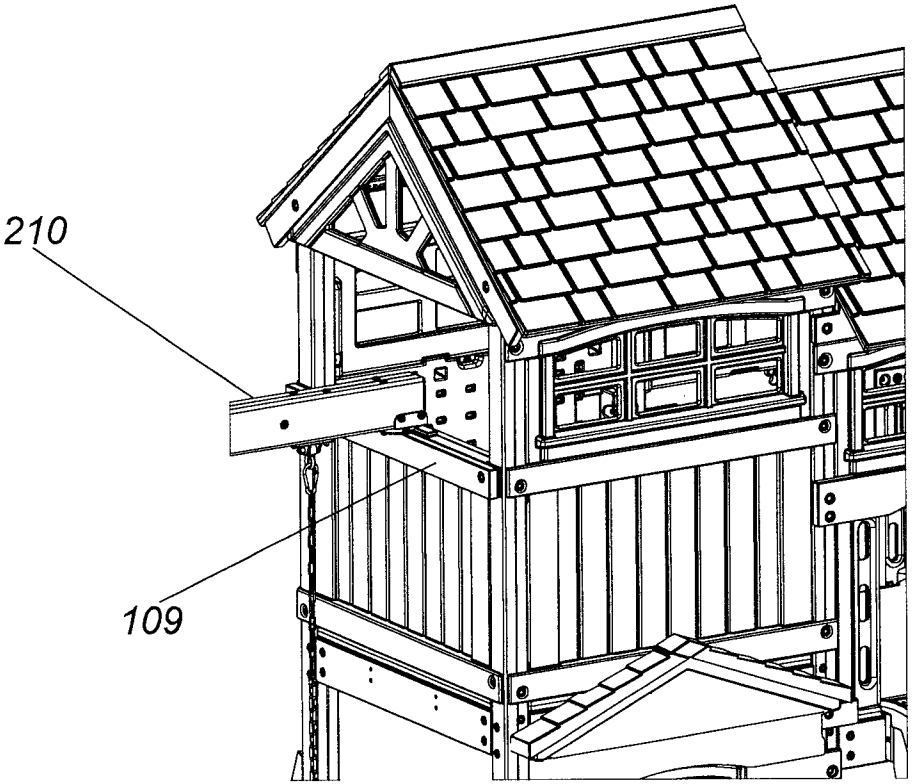
FIG. 8B is a view within area B in FIG. 8A.
Figure 9B:
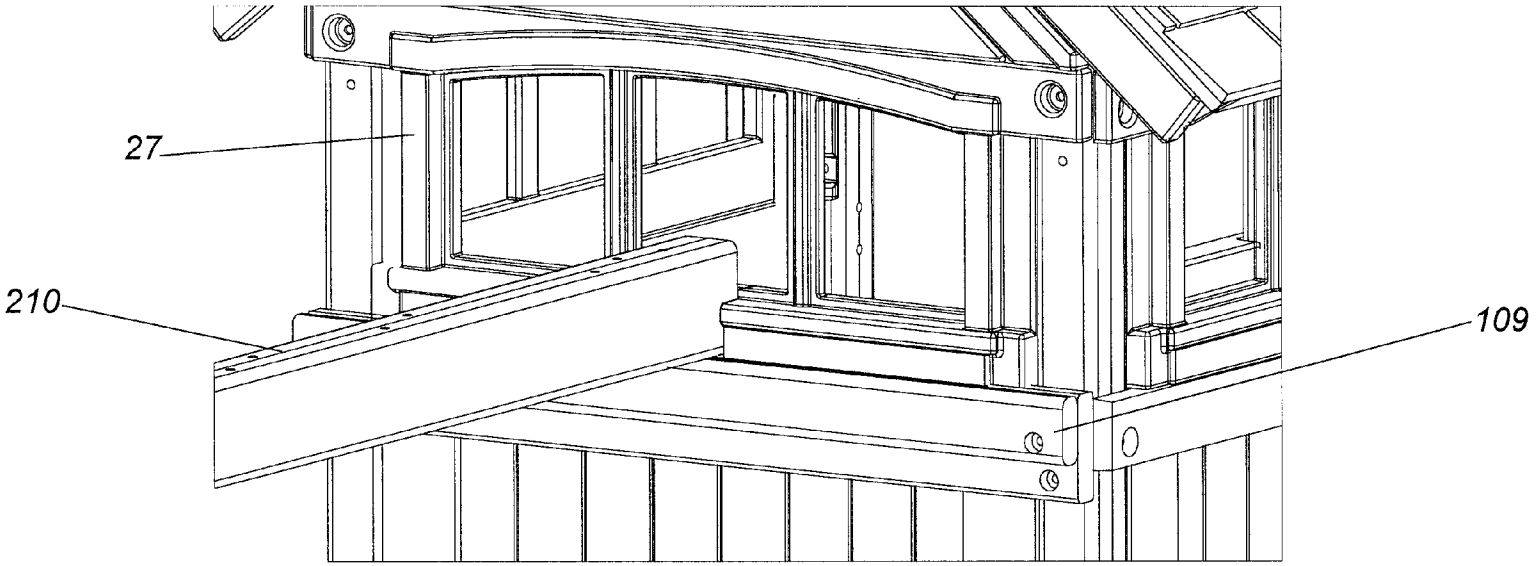
FIG. 9B is a view within area B in FIG. 9A.
Figure 9A:
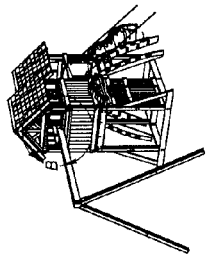
FIG. 9A is a side perspective view of the present invention.
Figure 10B:
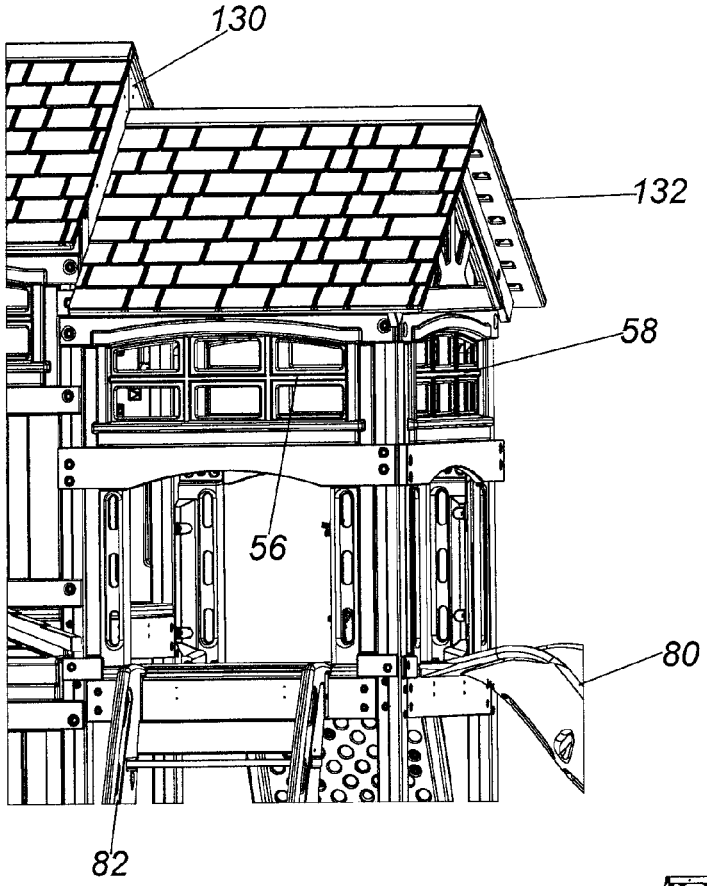
FIG. 10B is a view within area B in FIG. 10A.
Figure 10A:
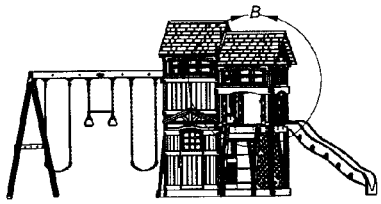
FIG. 10A is a front perspective view of the present invention.
Figures 11A, 11B:
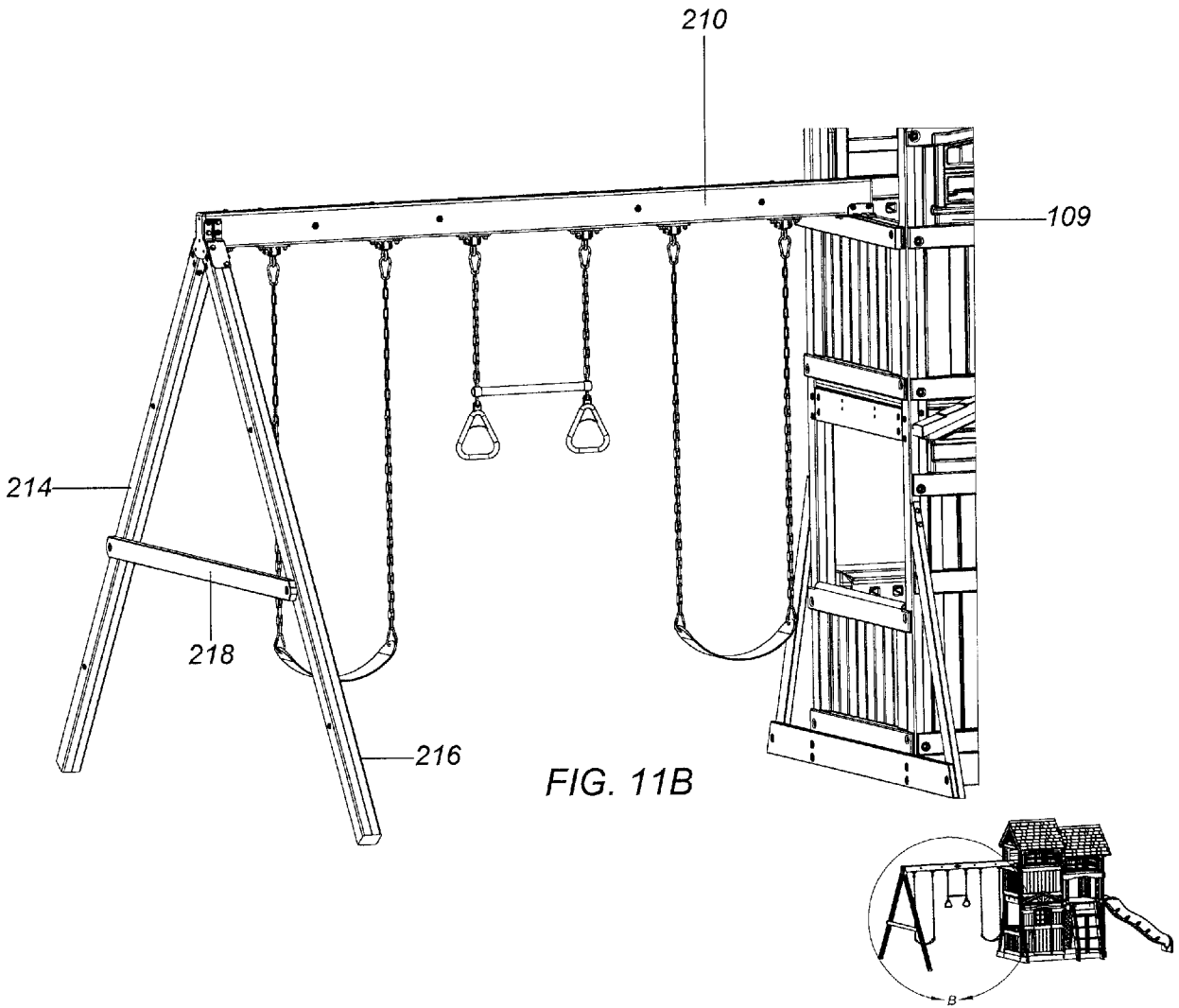
FIG. 11A is a front perspective view of the present invention.
FIG. 11B is a view of the swing set within area B in FIG. 11A.
Figure 23A:
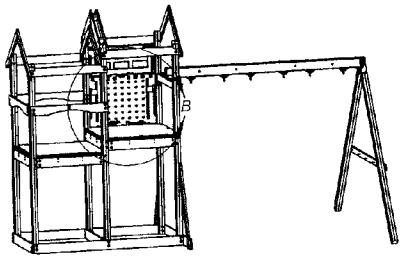
FIG. 23A is a rear perspective view of the present invention.
Figure 23B:
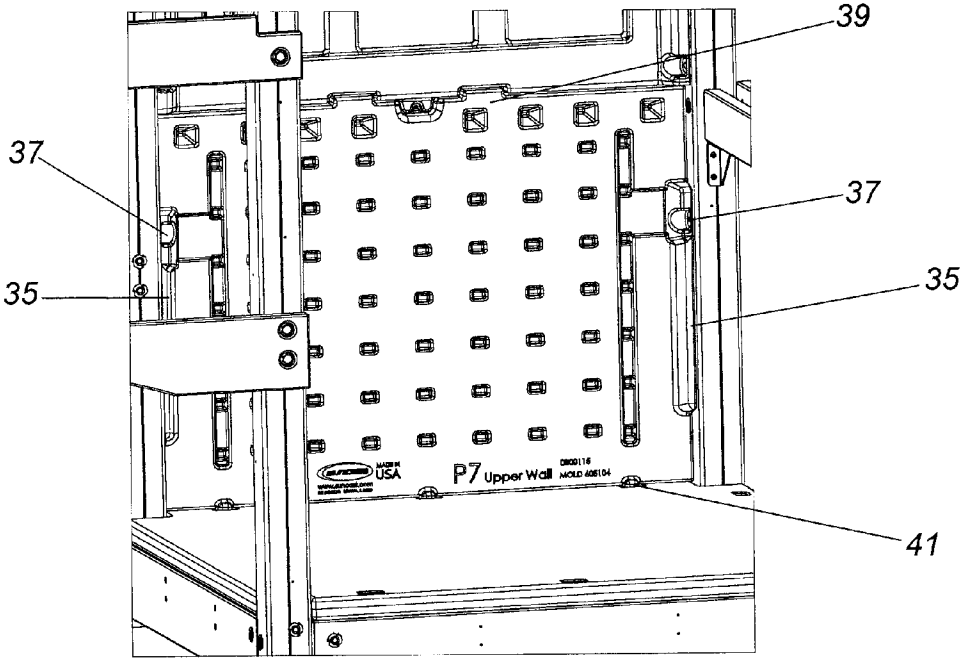
FIG. 23B is a view within area B in FIG. 23A.
Figure 24A:
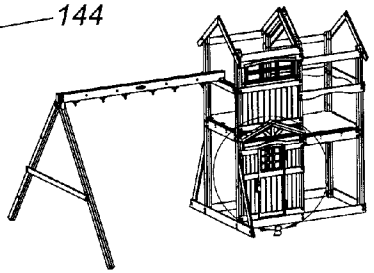
FIG. 24A is a rear perspective view of the present invention.
Figure 24B:
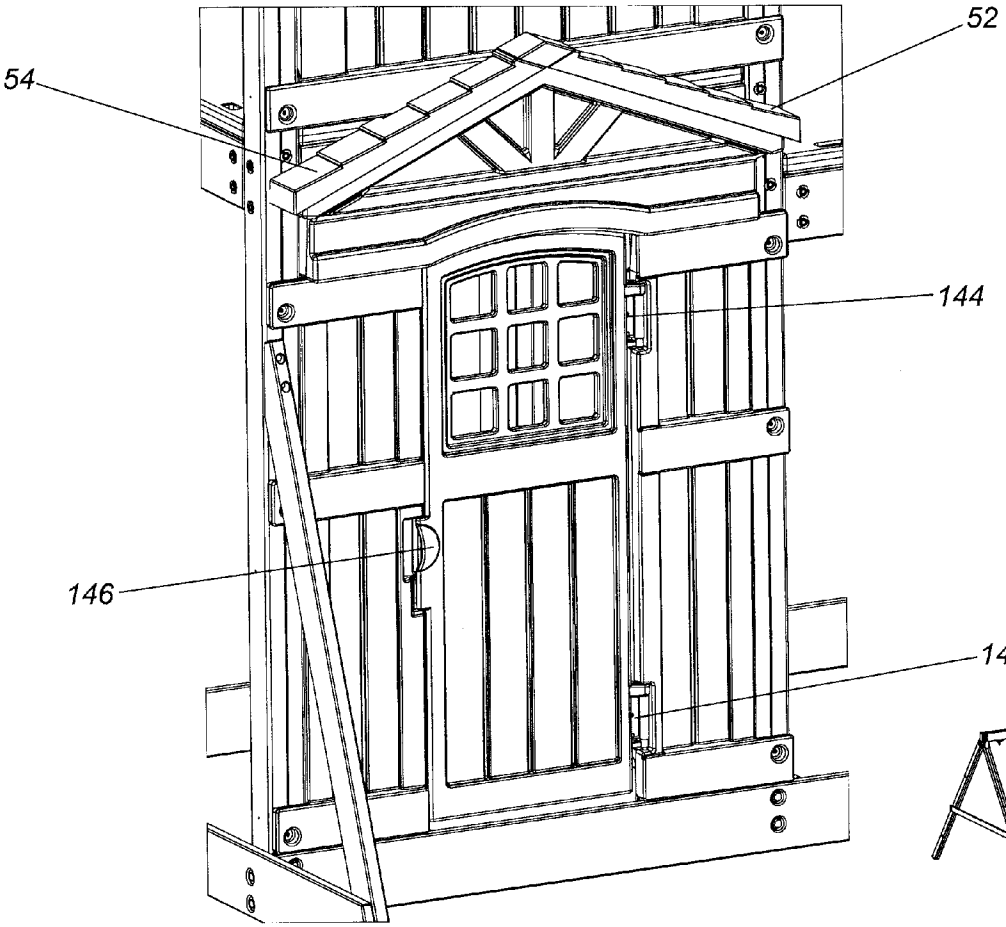
FIG. 24B is a view within area B in FIG. 24A.
Figure 45:
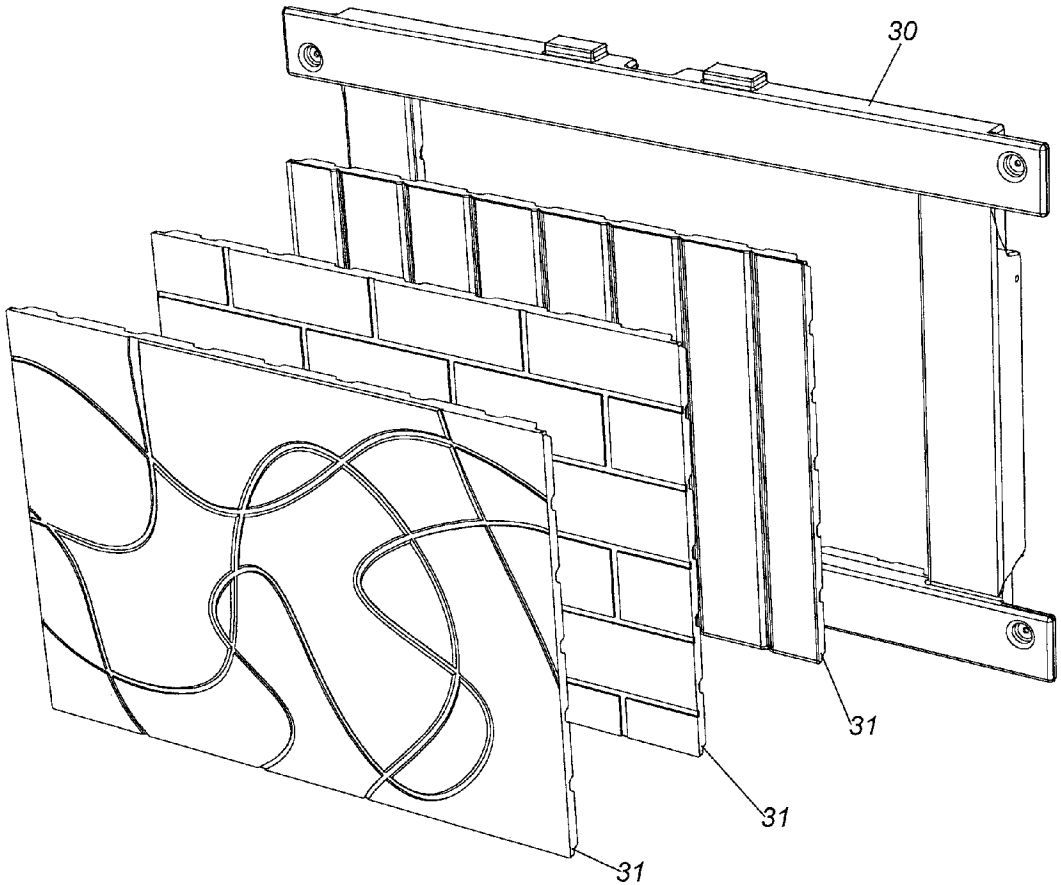
FIG. 45 is a view of a wall with various panel inserts.
Figure 46:
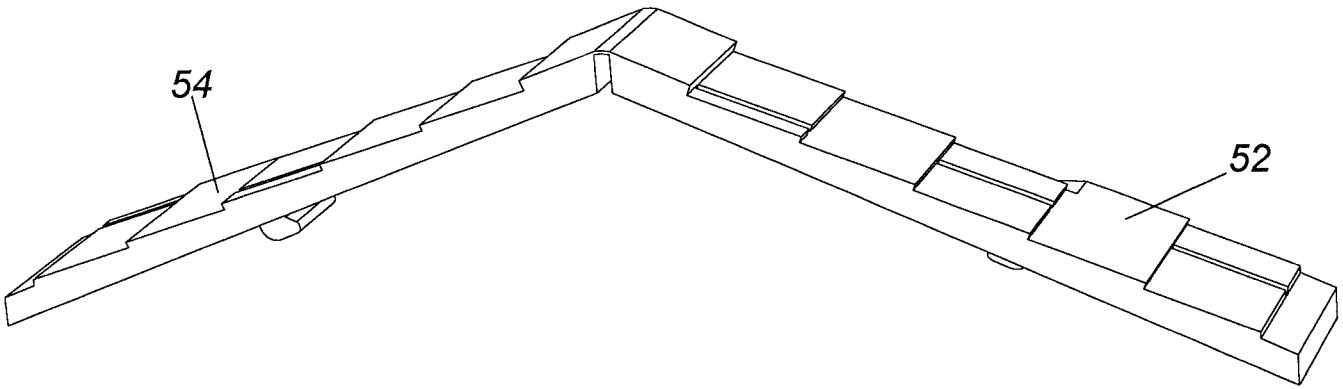
FIG. 46 is a view of a portion of a roof structure with a living hinge.
Figure 47:
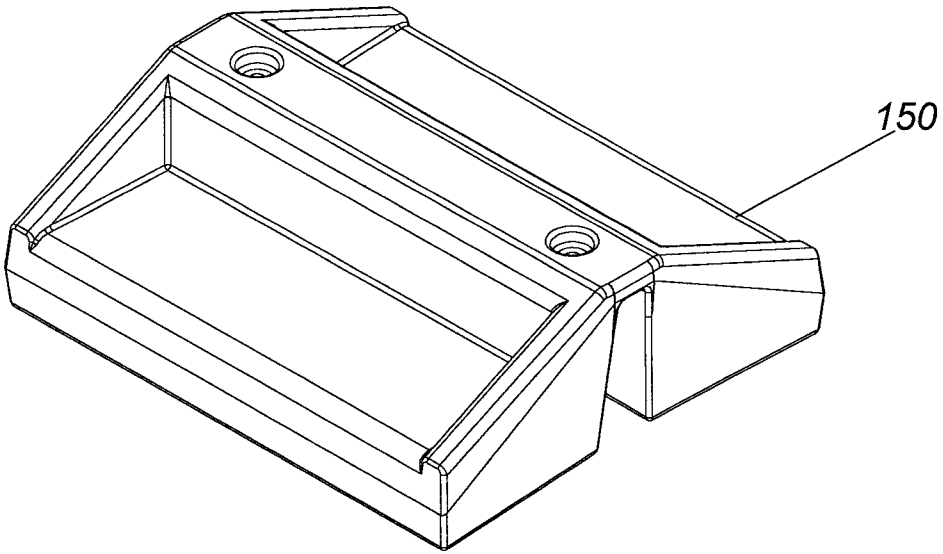
FIG. 47 is a perspective view of an optional ramp or stairs over the base frame.

As illustrated in the figures, play set 10 includes a tower 12. The tower 12 includes two tiers elevated above the ground, an upper tier 14 and a lower tier 16. While two tiers are illustrated in the preferred embodiment, any number of tiers can be employed. Each of the tiers 14, 16 includes an upper level 18, 20 and a lower level 22, 24. The upper level 20 of the upper tier 14 comprises an enclosed platform with two windows 26, 28 and three walls 30, 32, and 34 enclosing the space (FIGS. 1, 2, and 6). The walls 30, 32, and 34 include integrally molded connection points such as 35 (FIG. 23B). The connection points 35 include gusseted areas 37 through which fasteners can be placed to secure the walls to the posts of the tier. The walls 30, 32, and 34 also include connection points 39 along an upper portion and connection points 41 along a lower portion (FIG. 23B). In an alternative embodiment, the front surface of the walls 30, 32, 34 can include replaceable appearance surfaces 31 (FIG. 45). In a further alternative embodiment, a third window 27 can be employed (FIG. 9B). The third window surrounds the bar 210 of the swing set 200. Below the upper level 20 is a play house 38. The play house includes three short walls 40, 42, and 44 (FIGS. 1, 2, and 6) and a front façade 46. The façade 46 includes a door 48 which opens and closes. The area above the door 48 includes a gabled header 50 and two plastic shingled roof parts 52 and 54 (FIGS. 1, 24B, and 46). The gabled header 50 (FIG. 3) includes a pair of injection molded panels to permit a second color and a more realistic shingled-roof appearance. The roof parts 52 and 54 can alternatively be molded as a single part incorporating a living hinge. The area enclosed within these three walls and façade can be used as a sandbox. The short wall 44 helps to prevent small children from walking into the path of the swings. The blow molded construction of the play set enables elimination many of the brackets that are normally required to fasten together wood play set constructions. The blow molded plastic panels are able to incorporate integrally molded geometry, tabs, and attachment members which replace many of the brackets that would otherwise be required.

Figure 25A:
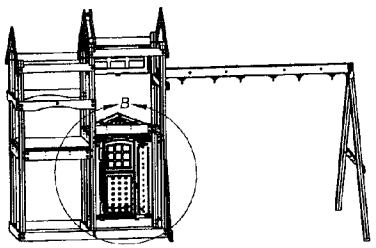
FIG. 25A is a rear perspective view of the present invention.
Figure 25B:
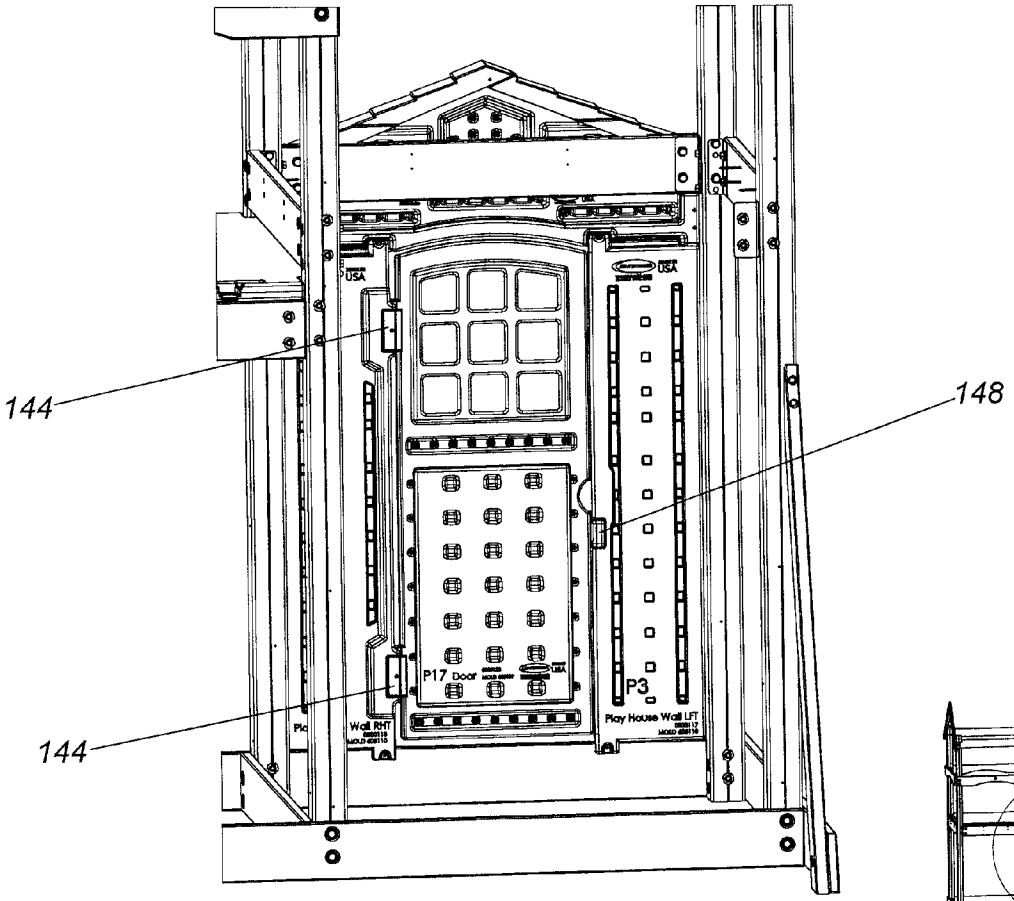
FIG. 25B is a view within area B in FIG. 25A.
Figure 26B:
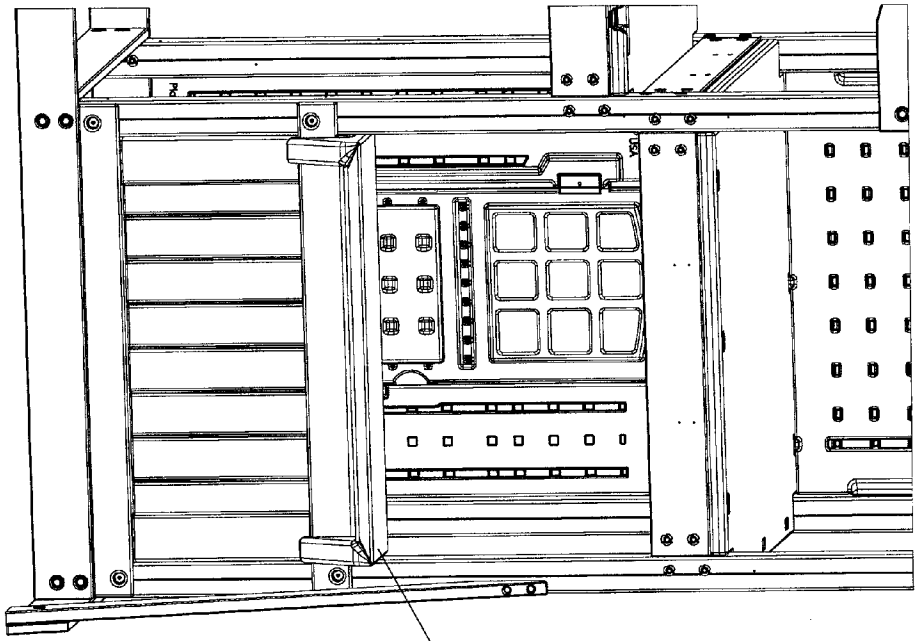
FIG. 26B is a view within area B in FIG. 26A.
Figure 26A:
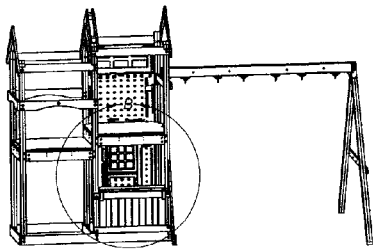
FIG. 26A is a rear perspective view of the present invention.

The door 48 is illustrated in detail in FIGS. 24B and 25B. The door 48 is preferably formed from blow molded plastic. The door hinges 144 are preferably steel. The door's closure 146 is a magnetic cabinet style. Attachment details are molded into the wall along the closing edge of the door 48. A small ramp or steps 150 (FIG. 47) can be added below the door 48 to bridge over the lower cross member. The short wall of the playhouse 38 can have a countertop 152 (FIG. 4) secured to the top thereof. The countertop 152 is formed from blow molded plastic in three sections which are connected by living hinges. The countertop 152 also includes passive attachment details integrally molded thereto.

Figure 3:
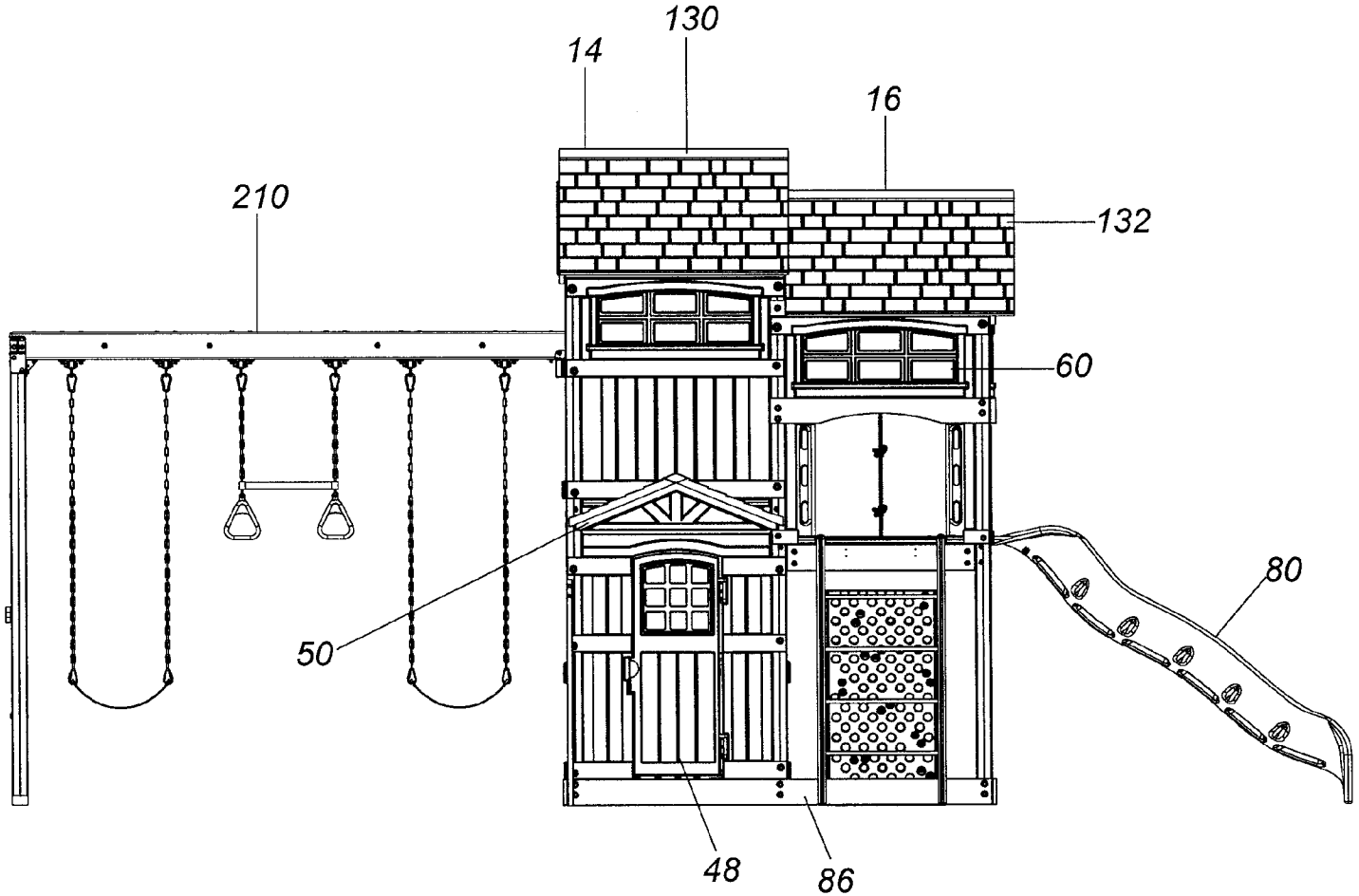
FIG. 3 is a front view of the present invention.
Figure 4:
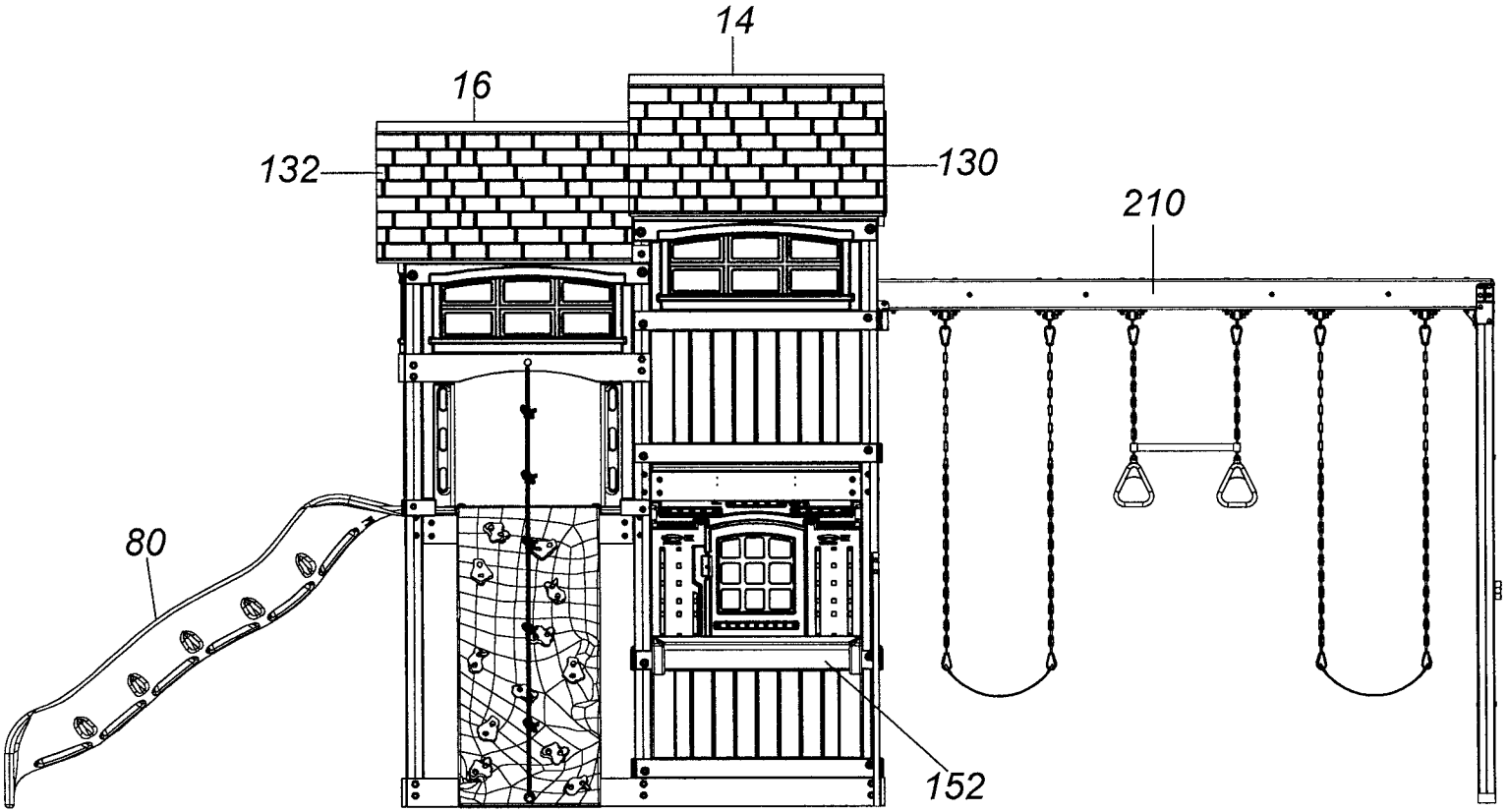
FIG. 4 is a rear view of the present invention.
Figure 5:
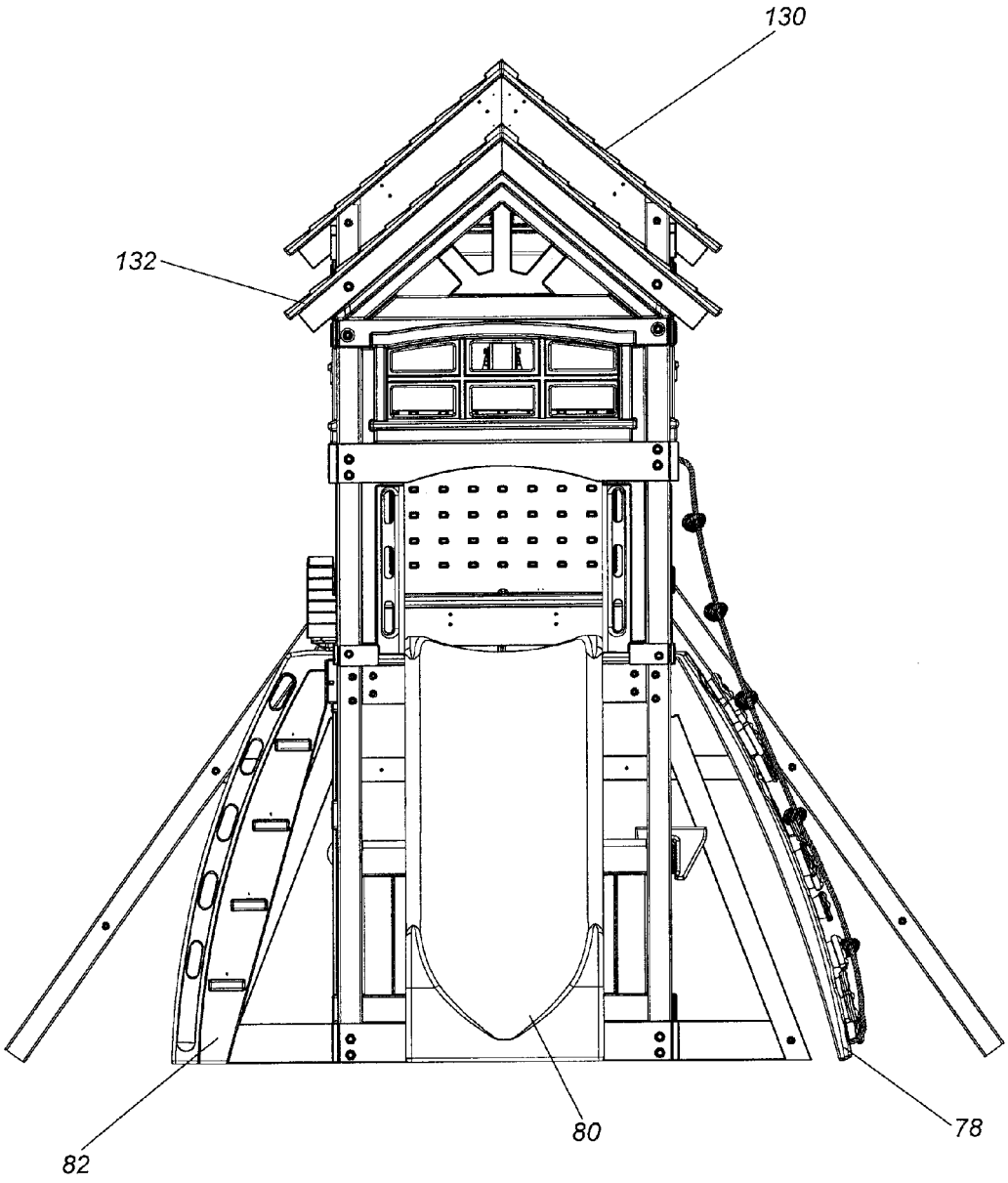
FIG. 5 is a right side view of the present invention.
Figure 20A:
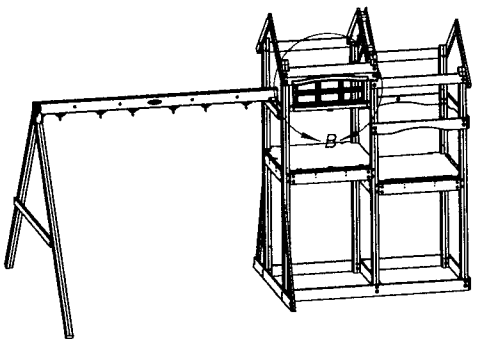
FIG. 20A is a front perspective view of the present invention.
Figure 20B:
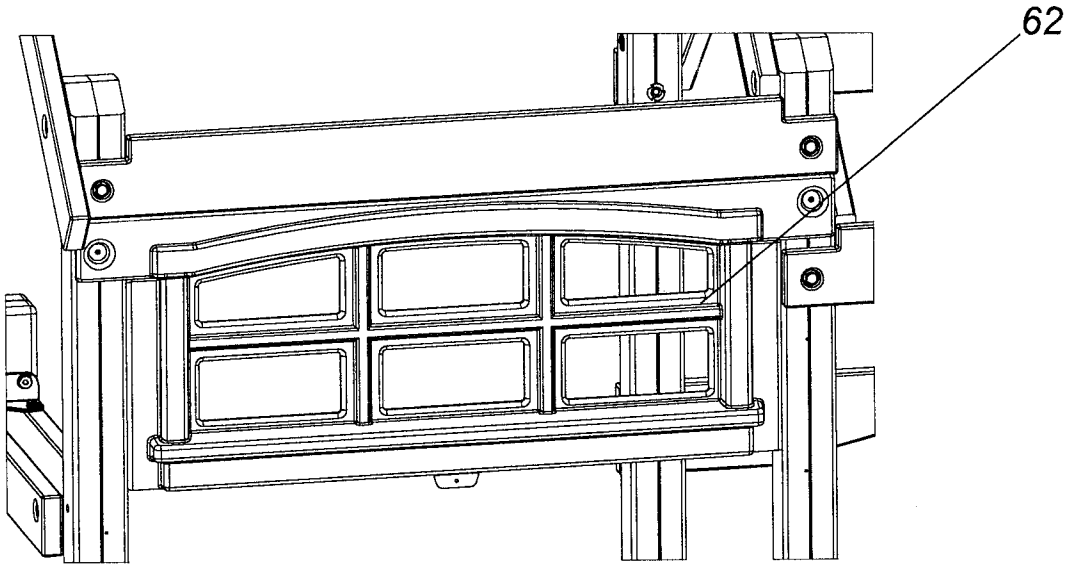
FIG. 20B is a view within area B in FIG. 20A.
Figures 21A, 21B:
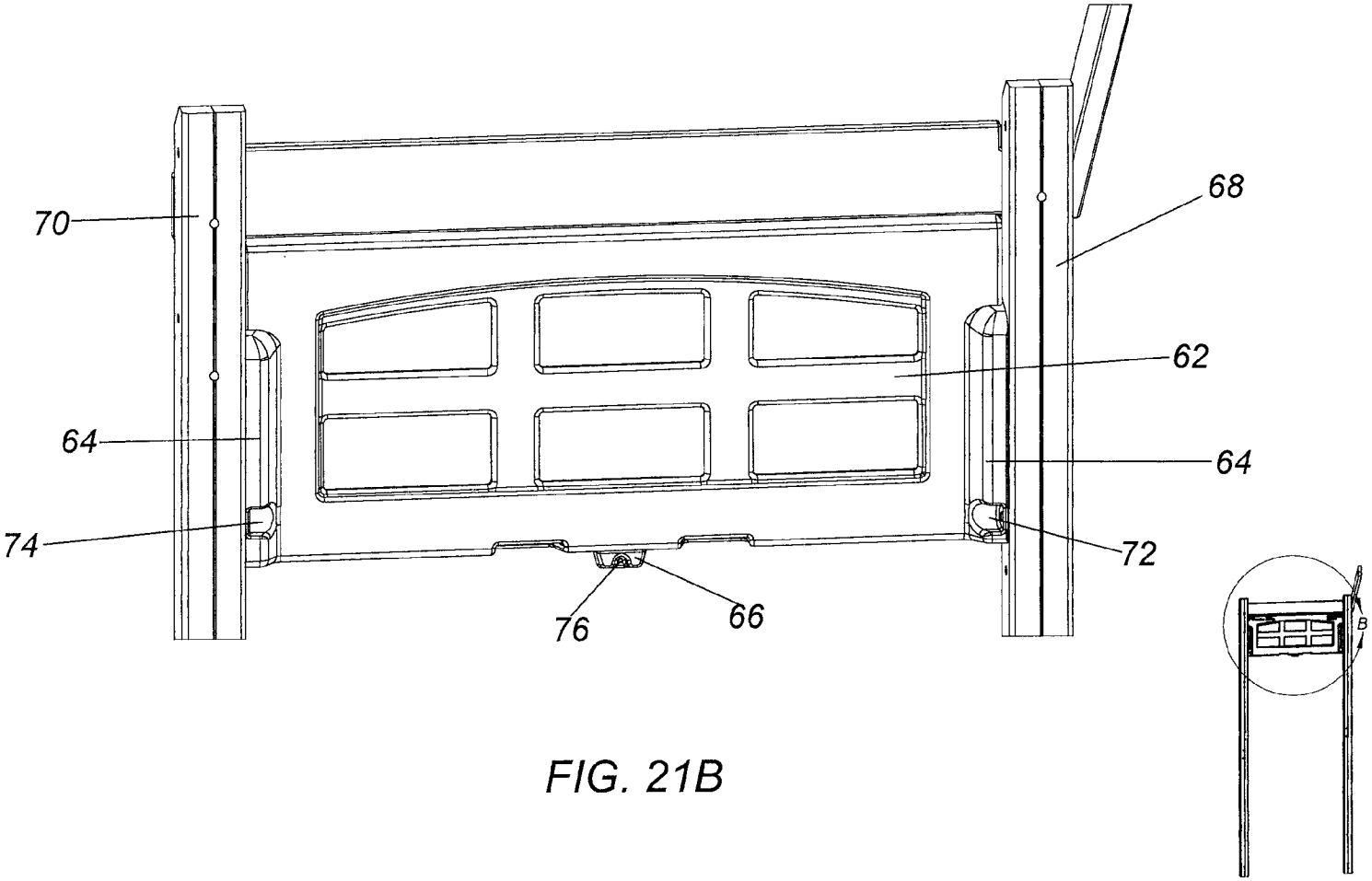
FIG. 21A is a view within a tower of the present invention.
FIG. 21B is a view within area B in FIG. 21A.
Figure 22A:
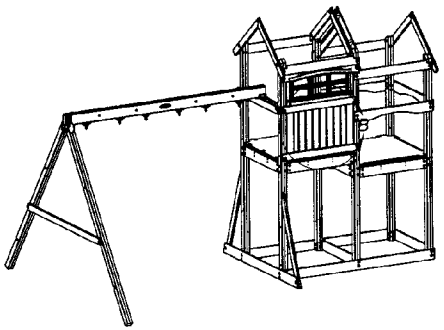
FIG. 22A is a front perspective view of the present invention.
Figure 22B:
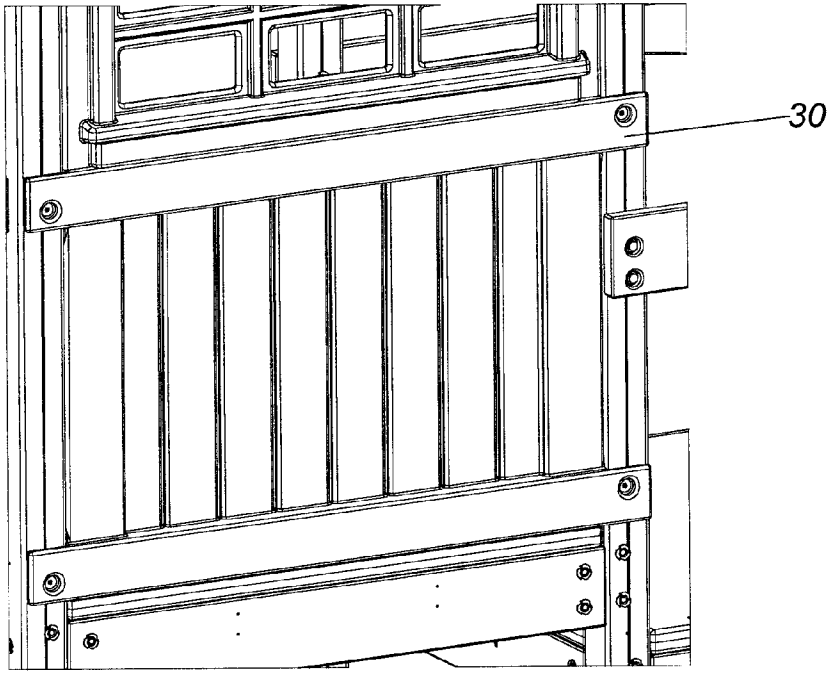
FIG. 22B is a view within area B in FIG. 22A.

The upper level 18 of the lower tier 16 includes three windows 56, 58, and 60 (FIGS. 1 and 3). The windows 26, 28, 56, 58, and 60 have no glass and thick mullions 62 (FIGS. 20B and 21B). The windows are also preferably blow molded and include connection points 64 and 66 molded into the window's sides and bottom edges (FIG. 21B). The connection points 64 can be secured to posts 68, 70 by fasteners placed in gusseted areas 72, 74. Connection point 66 can be secured to a cross brace by fasteners placed within the gusseted area 76. The window connection points 64, 66 are illustrated as being secured to blow molded plastic posts and cross member. However, the connection points can also be secured to posts and cross members made of wood or a composite wood/blow molded plastic material. The upper level 18 also includes four open sides below the windows. The open sides provide a connection for a climbing wall 78, a slide 80, and a ladder 82 (FIG. 2). While these components are illustrated as secured to the upper level 18 in a particular array, they can also be secured in various different arrays.

The lower level 22 of the lower tier 16 includes four posts 84. These posts can be made from blow molded plastic, wood, or a wood/plastic composite. Cross members 86 are secured to the lower portions of posts 84. These cross members provide structural stability to the lower level 22. These cross members, 86, can also outline or define a sandbox when the play set is placed on sand. In an alternative embodiment, the two tiers 14 and 16 are at the same level.

Figure 12:
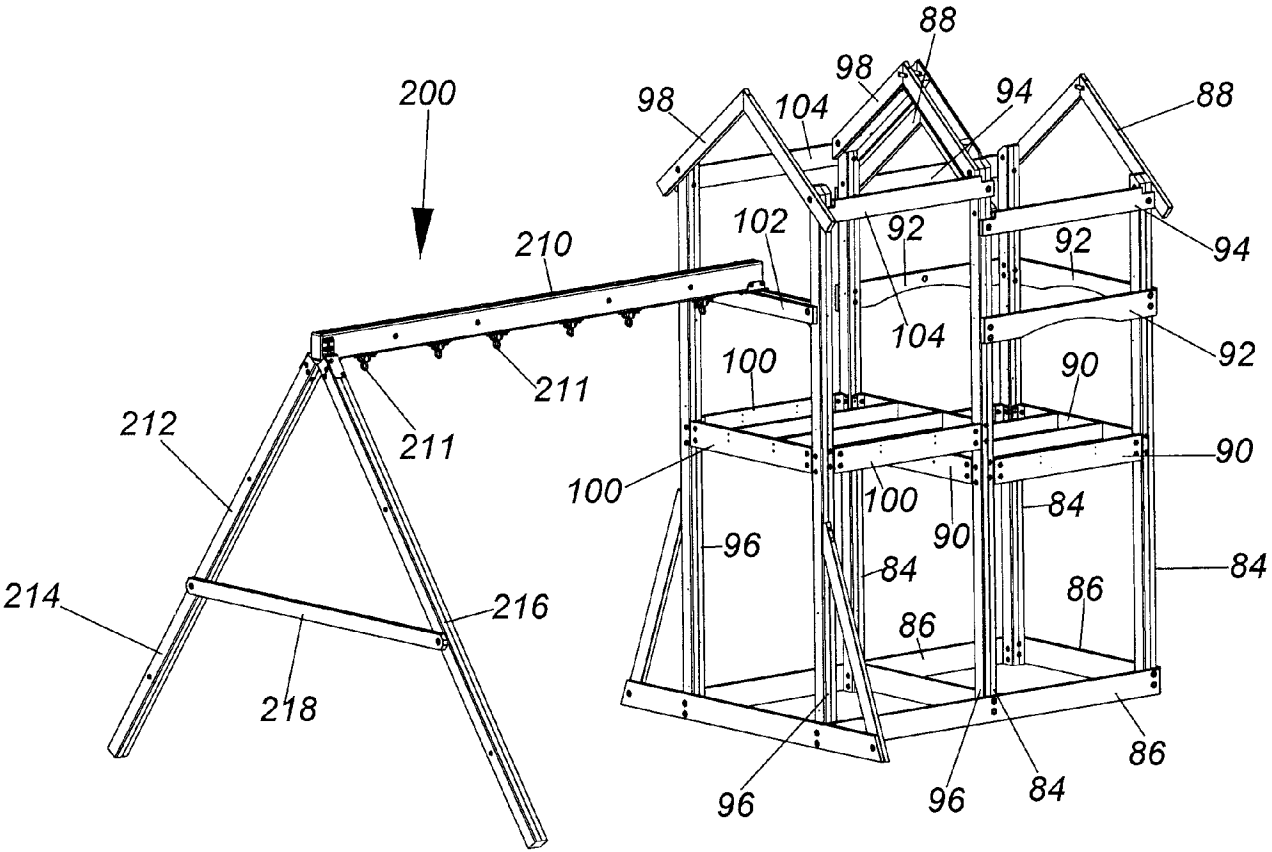
FIG. 12 is a front perspective view of the frame of the present invention.
Figure 13A:
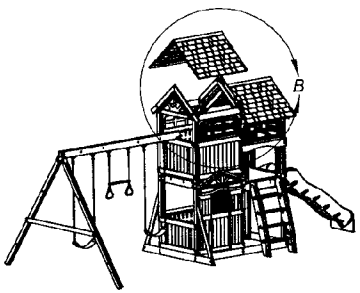
FIG. 13A is a front perspective view of the present invention.
Figure 13B:
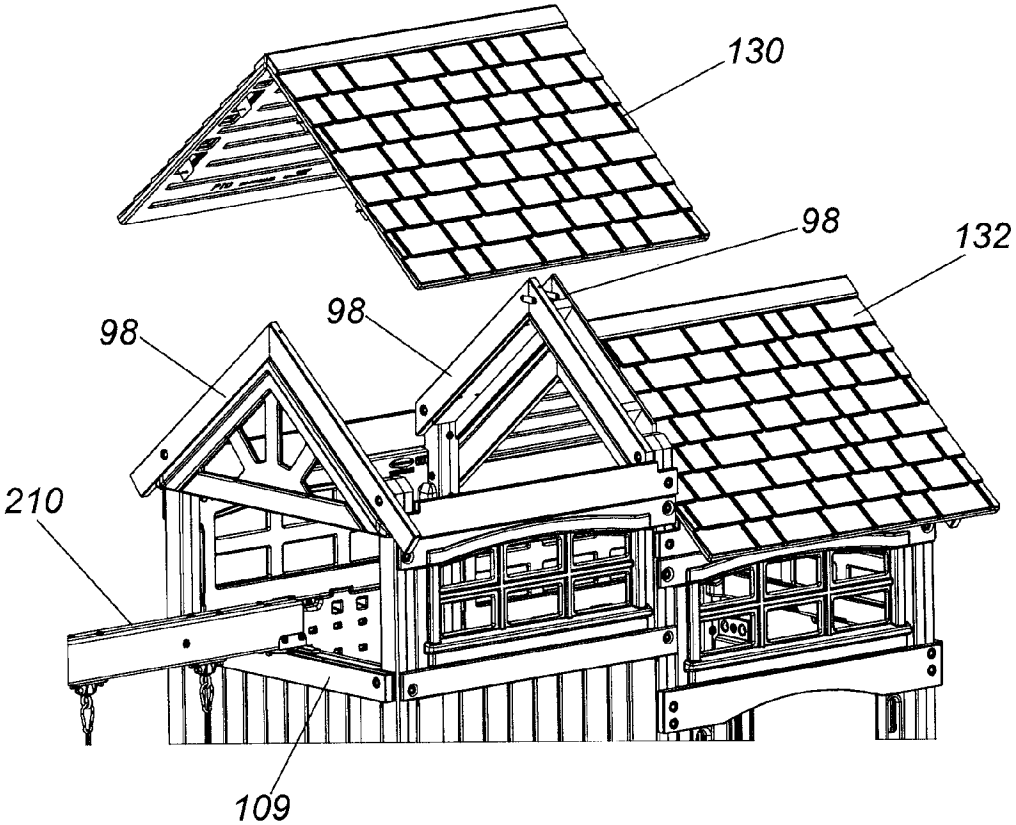
FIG. 13B is a view of the roof structure within area B in FIG. 13A.

The details of the construction of the two tiers 14 and 16 are illustrated in FIGS. 12-28B, 30A-31B, and 33A-36C. The posts 84 of the lower tier 16 extend from the ground to the roof rafters 88 (FIG. 12). Cross members 86 are secured to the lower portion of posts 84. Cross members 90 are secured to an intermediate portion of the posts 84. Cross members 92 are secured to the posts above cross members 90. Cross members 94 are secured to an upper portion of posts 84. As illustrated in FIG. 12, the cross members 94 and roof rafters 88 secure the upper portions or posts 84 to each other. The cross members 86, 90, 92 and 94 are secured to the posts 84 by fasteners, such as screws, bolts, nails, etc. The cross members 86, 90, 92 and 94 can be made of blow molded plastic, wood or a wood/blow molded plastic composite.

The upper tier 14 comprises at least four posts 96 which extend from the ground to the roof rafters 98 (FIG. 12). Cross members 86 are secured to the lower portion of posts 96 in a preferred embodiment. Alternatively, four other cross members could be secured to the lower portions of posts 96. Cross members 100 are secured to an intermediate portion of the posts 96. Cross members 102 are secured to the posts above cross members 100. Cross members 104 are secured to an upper portion of posts 96. As illustrated in FIG. 12, the cross members 104 and roof rafters 98 secure the upper portions or posts 96 to each other. The cross members 96, 100, 102 and 104 are secured to the posts 96 by fasteners, such as screws, bolts, nails, etc. The posts 96 and cross members 86, 100, 102 and 104 can be made of blow molded plastic, wood or a wood/blow molded plastic composite.

The upper levels 18 and 20 include floors 108 and 106 respectively (FIGS. 15B-18B). Floor 106 comprises a base which is formed from cross members 100 and floor joists 110. Corner brackets 112, which are preferably steel, help secure the cross members 100 to the posts 96. Floor joists 110 are secured to the cross member 100 by fasteners. A floor panel 114 is placed on top of the cross members 100 and floor joists 110 and secured thereto (FIGS. 16B-18B) The corners of the floor panel 114 are cut away to permit the floor panel 114 to partially surround posts 96. Floor panel 114 includes apertures or molded-in features 116 which permit walls and other structural elements to be secured to the floor panel 114. The floor panel is preferably made from blow molded plastic, and the floor joists are preferably made from wood. The underside of floor panel 114 includes tack offs 118. The tack offs 118 run substantially perpendicular to the floor joists 110 in order to provide reinforcement to the floor panel.

Floor 106 comprises a base which is formed from cross members 90 and floor joists 120. Corner brackets 122, which are preferably steel, help secure the cross members 90 to the posts 84. Floor joists 120 are secured to the cross member 90 by fasteners. A floor panel 124 is placed on top of the cross members 90 and floor joists 120 and secured thereto (FIGS. 16B-18B) The corners of the floor panel 124 are cut away to permit the floor panel 124 to partially surround posts 84. Floor panel 124 includes apertures or molded-in features 126 which permit walls and other structural elements to be secured to the floor panel 124. The floor panel is preferably made from blow molded plastic, and the floor joists are preferably made from wood. The underside of floor panel 124 includes tack offs 128. The tack offs 128 run substantially perpendicular to the floor joists 120 in order to provide reinforcement to the floor panel.

Figure 14:
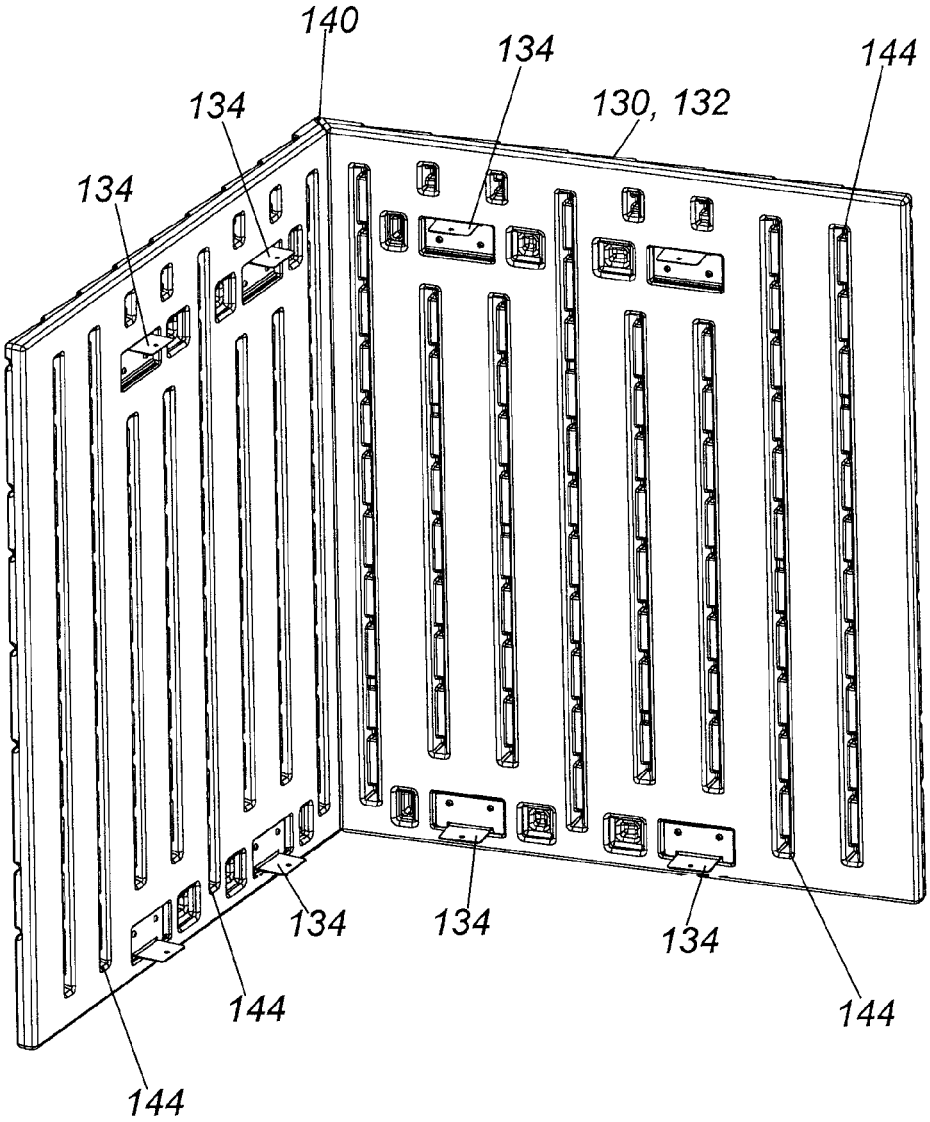
FIG. 14 is a view of the under side of the roof.
Figure 15B:
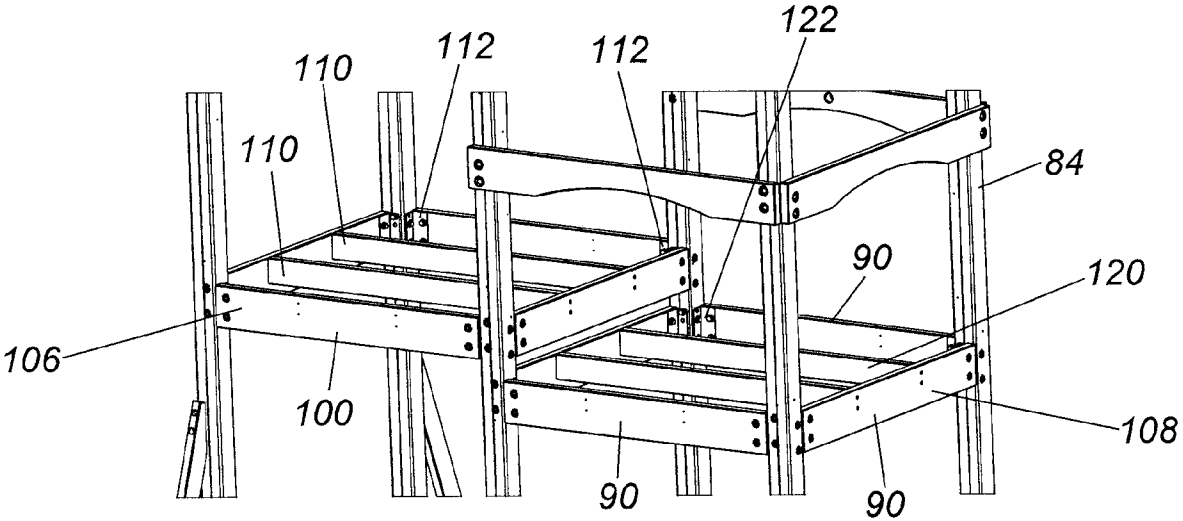
FIG. 15B is a view within area B in FIG. 15A.
Figure 15A:
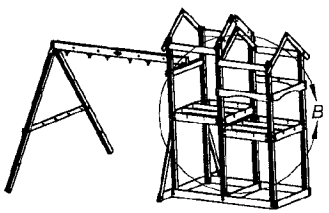
FIG. 15A is a front perspective view of the present invention.
Figure 16B:
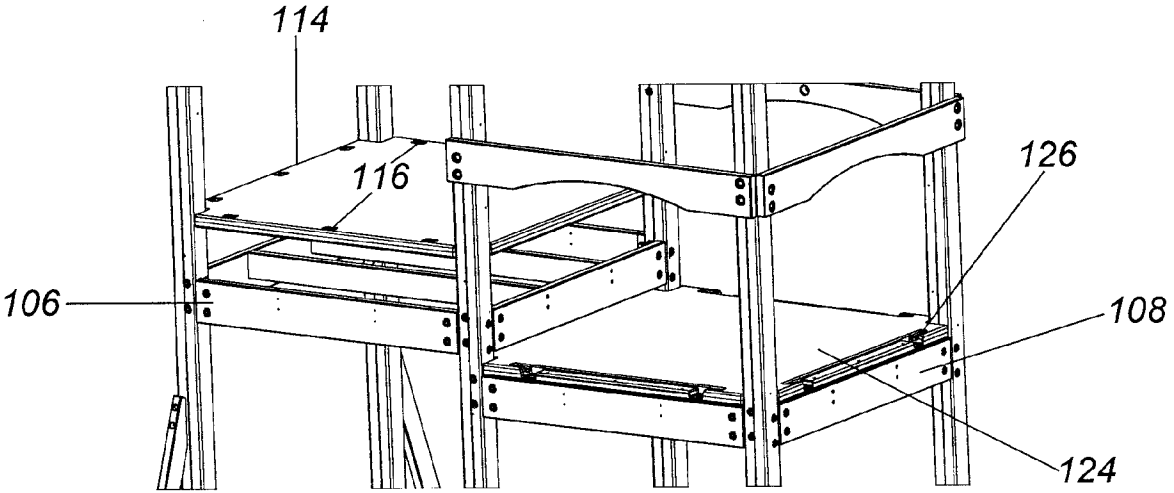
FIG. 16B is a view within area B in FIG. 16A.
Figure 16A:
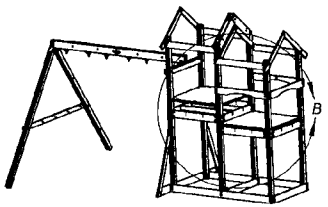
FIG. 16A is a front perspective view of the frame of the present invention.
Figure 17A:
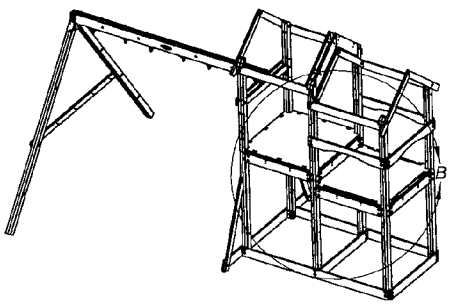
FIG. 17A is a front perspective view of the present invention.
Figure 17B:
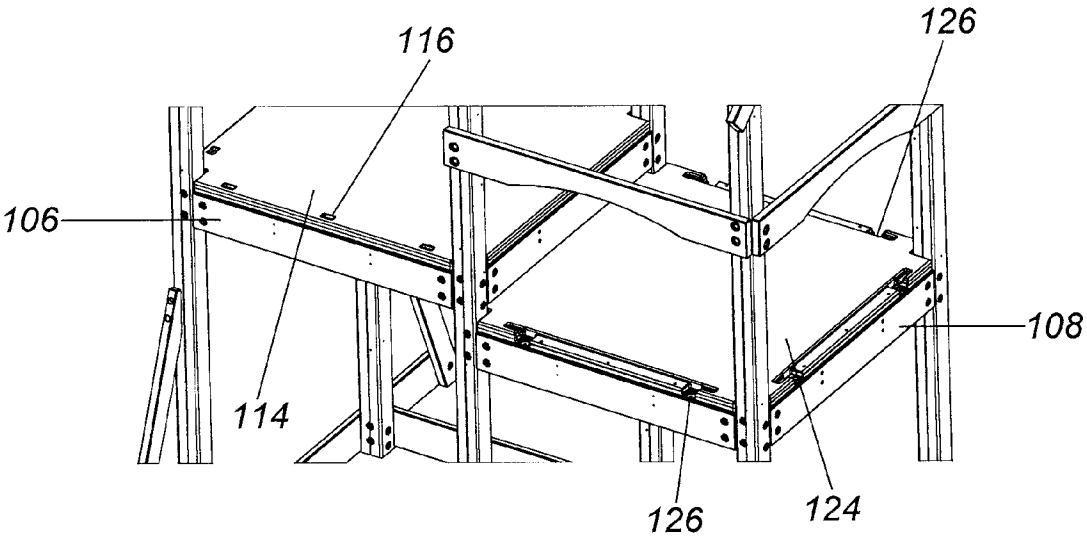
FIG. 17B is a view within area B in FIG. 17A.
Figure 18A:
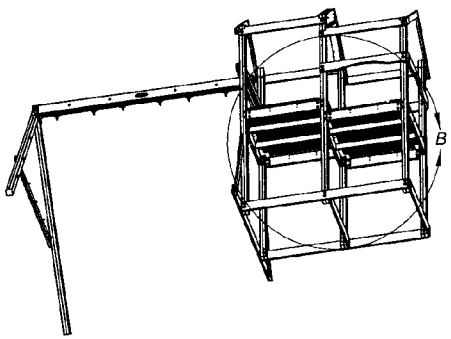
FIG. 18A is a front perspective view of the present invention.
Figure 18B:
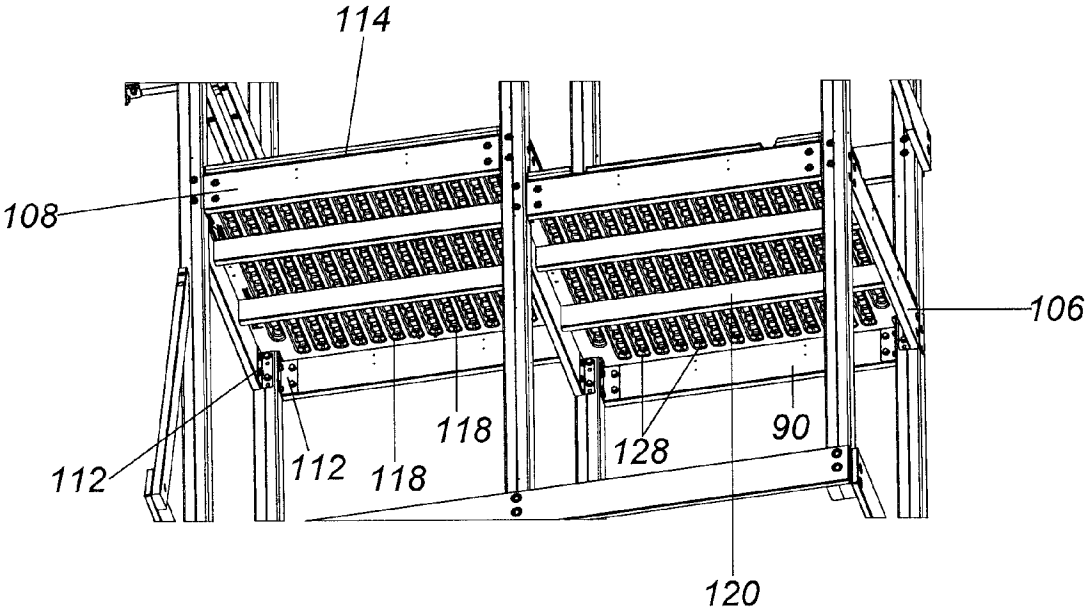
FIG. 18B is a view within area B in FIG. 18A.
Figure 19B:
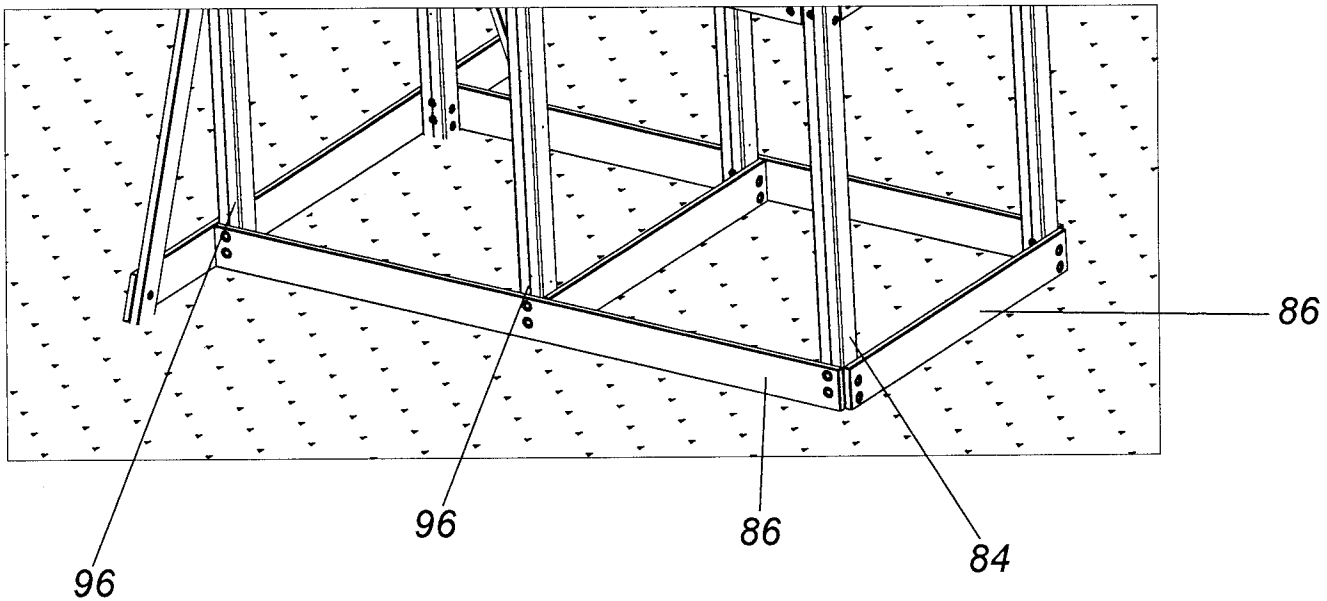
FIG. 19B is a view within area B in FIG. 19A.
Figure 19A:
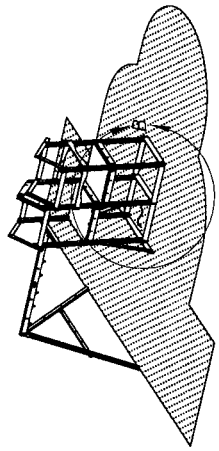
FIG. 19A is a front perspective view of the present invention.

The upper tier 14 has a roof 130 secured to the top thereof. Roof 130 is secured to the roof rafters 98 (FIG. 12). The lower tier 16 has a roof 132 secured to the top thereof. Roof 132 is secured to the roof rafters 88 (FIG. 12). The top side of the roofs 130 and 132 include molded in shingles to make them aesthetic pleasing. The underside of the preferred embodiment of roofs 130 and 132 is illustrated in FIG. 14. Brackets, preferably steel, 142 are secured to the roofs 130 and 132. These brackets 134 include apertures through which fasteners can be placed to secure the roofs 130 and 132 to the roof rafters 98 and 88 respectively. The two sections of the roof are secured together by a single living hinge 140 (FIG. 14). The roofs 130 and 132 are made from blow molded plastic. The roof also includes reinforced tack offs 144 on the underside thereof to help reinforce the roof. In an alternative embodiment, illustrated in FIG. 44, each section of the roof includes a roof vent cap 136, 138 (FIG. 43) which is permanently secured to one section of the roof and removably secured to the other section of the roof. Each roof section further includes a plurality of fastening projections 146 which mates with fastening receiving elements located below the vent caps 138 and 136 respectively. The alternative embodiment of the roof also includes different brackets 142 to secure the roof to the roof rafters.

The bases of each of the tiers 14 and 16 of the tower 12 are open so that a soft ground covering can be utilized in play areas. For example, sand can be employed as a ground cover and the bases of the tiers can then be utilized as sand boxes. Mulch, grass, artificial ground coverings, etc. can also be employed. The primary purposes of the ground cover are to support the play set and prevent injury to a person when they fall onto the ground.

Figures 27A, 27B:
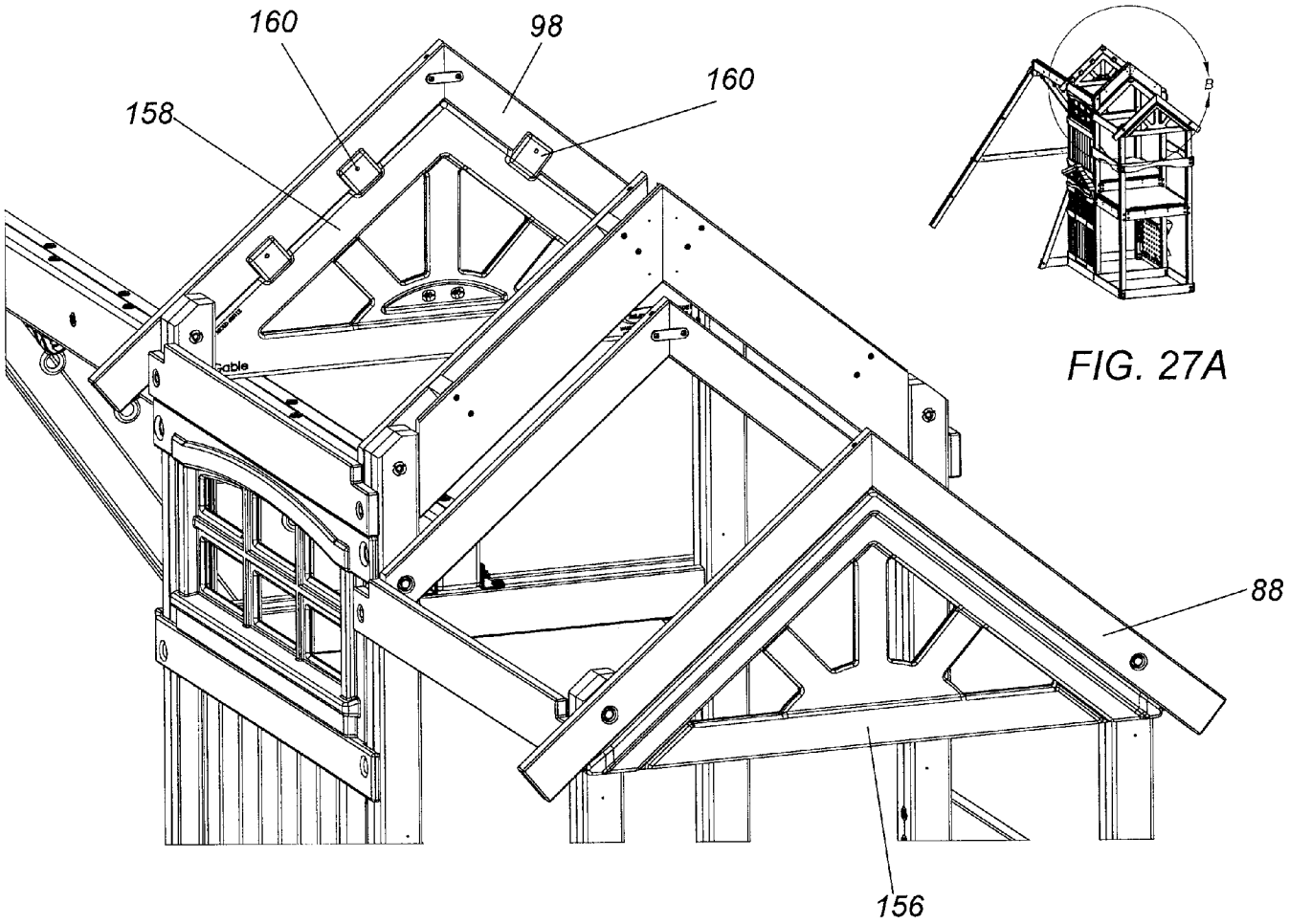
FIG. 27A is a right side perspective view of the present invention.
FIG. 27B is a view within area B in FIG. 27A.

The upper portions of the tiers 14 and 16 include gable ends 156 and 158 below the roof rafters 88 and 98 respectively (FIG. 27B). The gable ends 156 and 158 are preferably blow molded from plastic and include attachment tabs 160 integrally molded thereto. These attachment tabs 160 cooperate with fasteners to secure the gable ends 156, 158 to the roof rafters. In a preferred embodiment there is no window below gable 156. However, in an alternative embodiment, there can be a window with a notch to allow securement of the swing beam to the lower tier, which will be described wherein after.

Figure 28A:
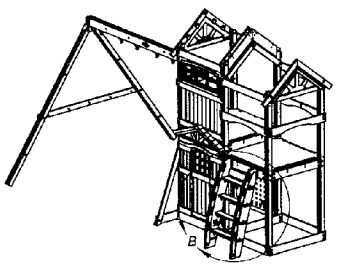
FIG. 28A is a right side perspective view of the present invention.
Figure 28B:
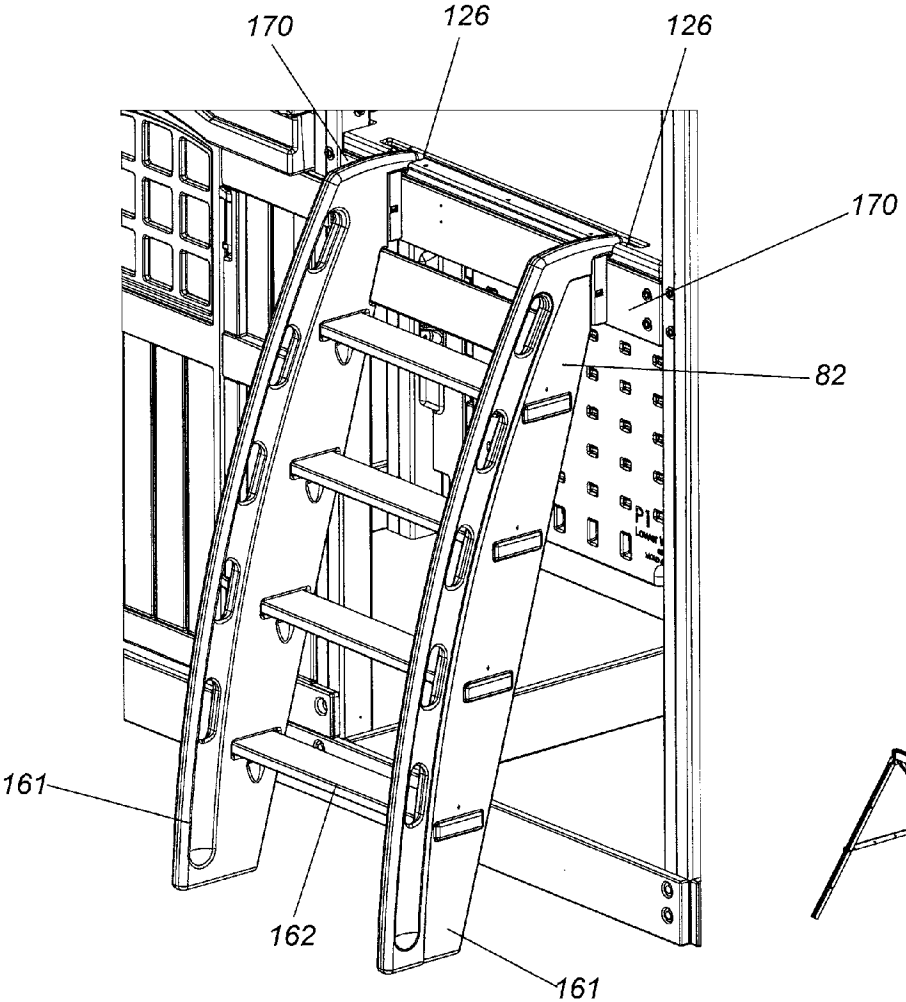
FIG. 28B is a view within area B in FIG. 28A.
Figure 29:
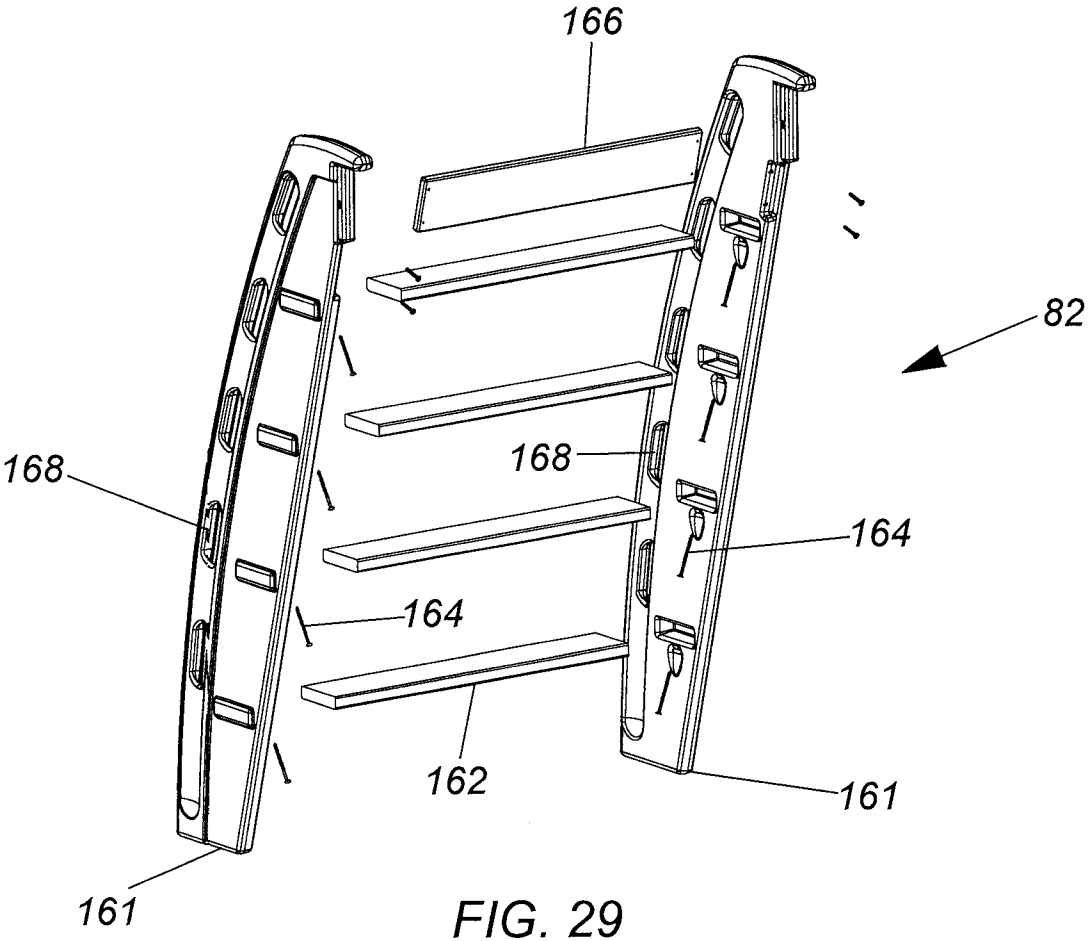
FIG. 29 is an exploded view of a ladder of the present invention.
Figure 30A:
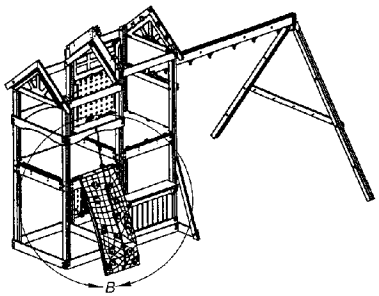
FIG. 30A is a rear perspective view of the present invention.
Figure 30B:
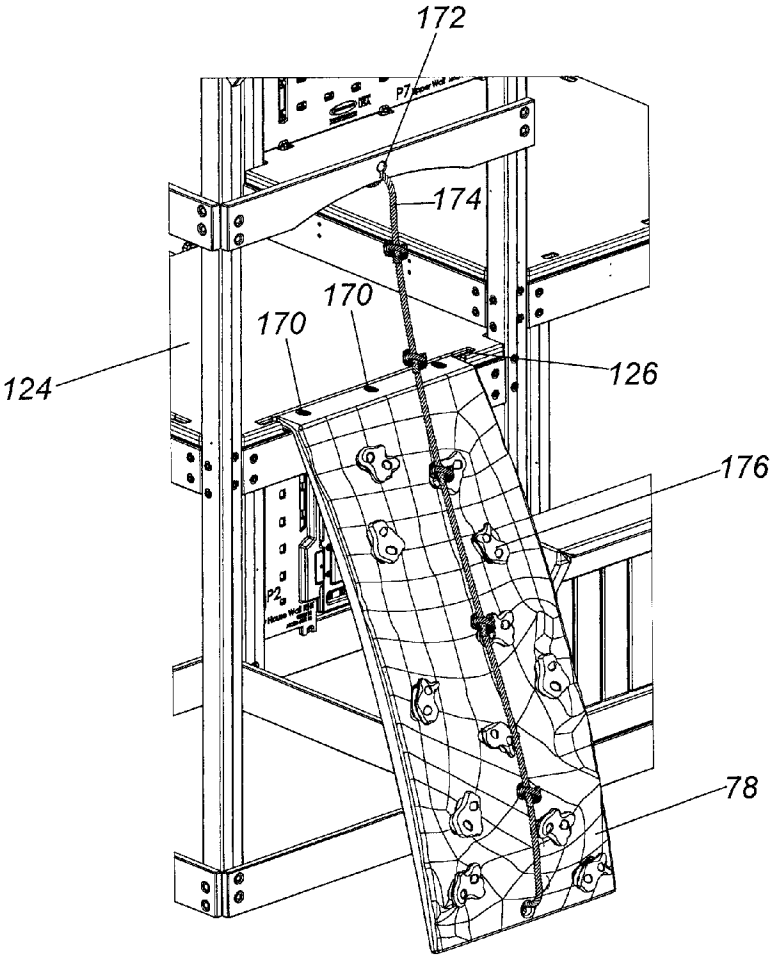
FIG. 30B is a view within area B in FIG. 30A.
Figure 31A:
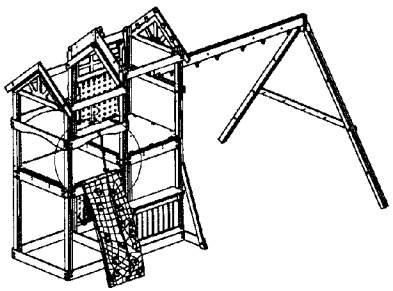
FIG. 31A is a rear perspective view of the present invention.
Figure 31B:
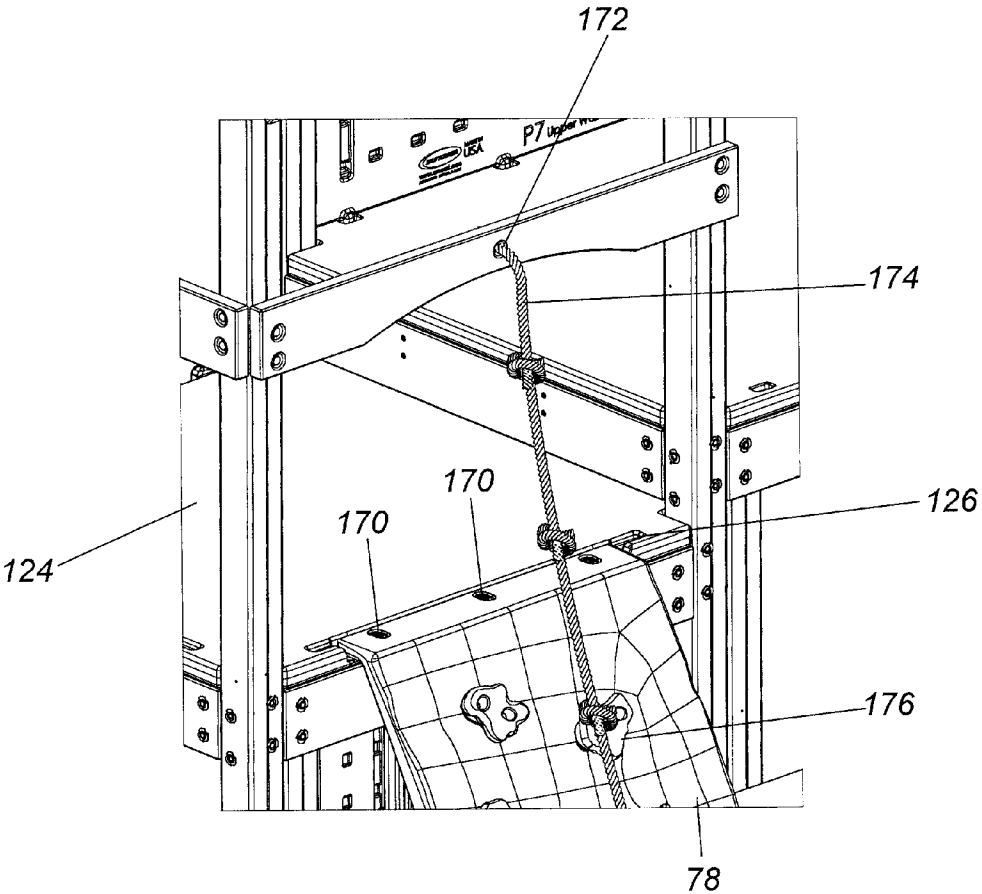
FIG. 31B is a view within area B in FIG. 31A.
Figure 32A:
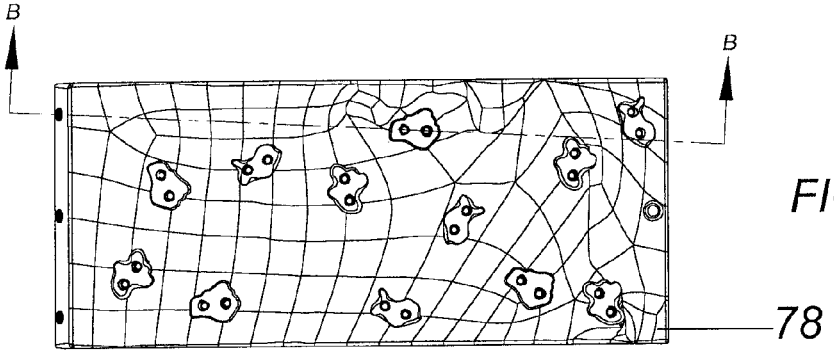
FIG. 32A is a front view of a climbing wall of the present invention.
Figure 32B:
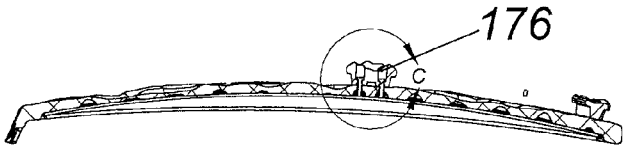
FIG. 32B is a view taken along line T-T in FIG. 32A.
Figure 32C:
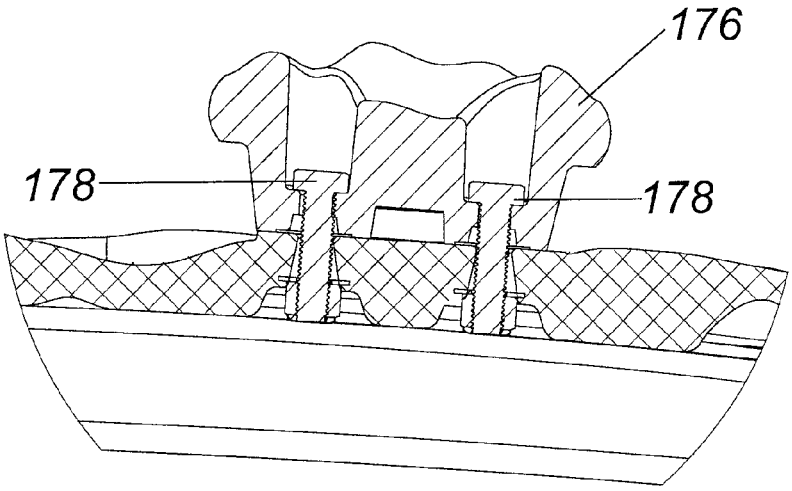
FIG. 32C is a view within area C in FIG. 32B.
Figure 48:
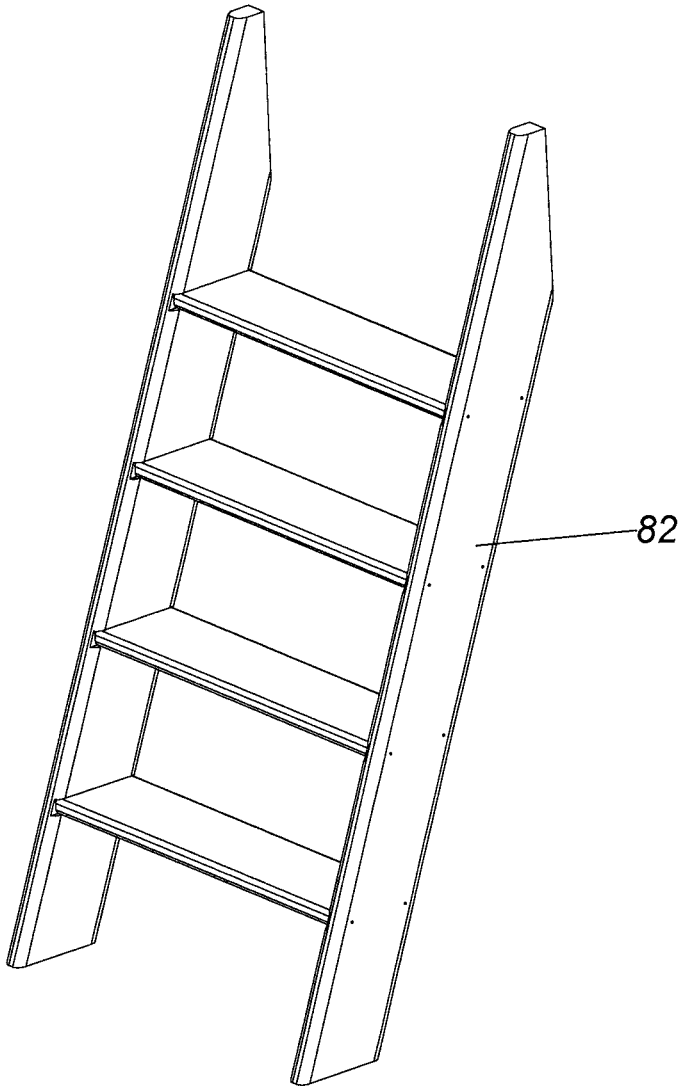
FIG. 48 is a perspective view of an alternative ladder.

The ladder 82 is illustrated in detail in FIGS. 28B and 29. The ladder 82 includes two sides 161 which are formed from blow molded plastic and steps 162 which are made from wood. The ladder 82 can be secured to any of the three open sides of the lower tier 16. Fasteners 164 are employed to secure the steps 162 to the sides 161 of the ladder. A cross brace 166 is secured to an upper portion of the sides 161. The sides 161 of the ladder have hand grips 168 integrally molded therein. Alternatively, a grab rail (not shown) can be secured to each of the sides of the ladder to assist an individual when ascending the ladder. The ladder 82 is secured to the tier 16 with steel brackets 170 and upper portions of the sides which fit into the apertures 126 of the floor panel 124. Alternatively, the sides of the ladder can be made from wood, as illustrated in FIG. 48.

Figure 49:
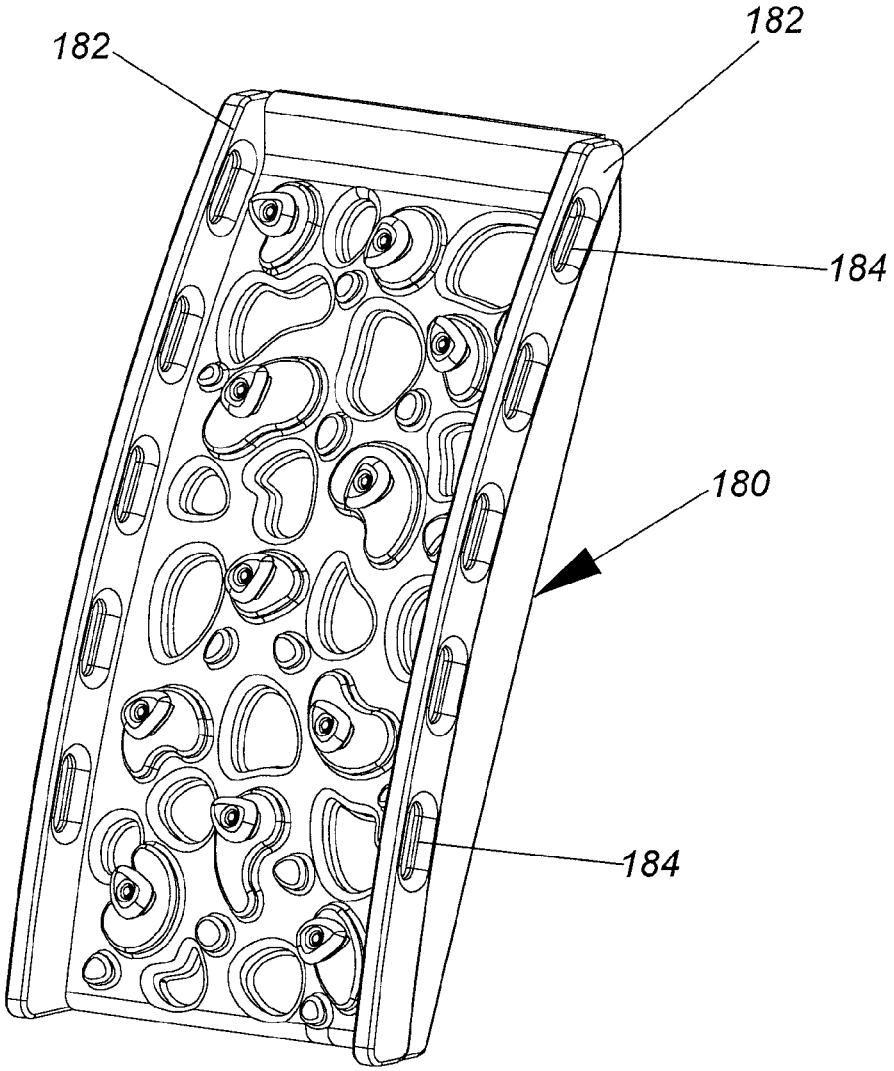
FIG. 49 is a perspective view of a climbing wall with ladder rail sides.

The climbing wall 78 is illustrated in detail in FIGS. 30B, 31B and 32A-C. The climbing wall 78 can also be secured to any of the three open sides of the lower tier 16. The climbing wall 78 is secured to the tier 16 with fasteners 170 which fit into the apertures 126 of the floor panel 124. The cross member above the climbing wall 78 includes an aperture 172 through which a rope 174 is secured to the cross member. The other end of rope 174 is secured to the climbing wall 78. The climbing wall 78 also includes molded plastic hand holds 176. The hand holds 176 are secured to the climbing wall with fasteners 178. In the preferred embodiment, threaded fasteners 178 are employed. However, other types of fasteners can also be utilized. The climbing wall is able to simulate the appearance of a natural rock due to the free-form design possibilities of blow molded elements. An alternative climbing wall 180 is illustrated in FIG. 49. The alternative embodiment includes sides 182 with hand holds 184.

Figure 33A:
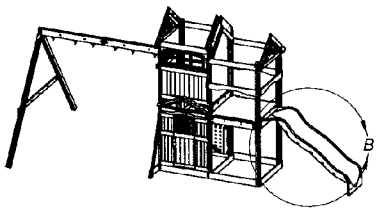
FIG. 33A is a rear perspective view of the present invention.
Figure 33B:
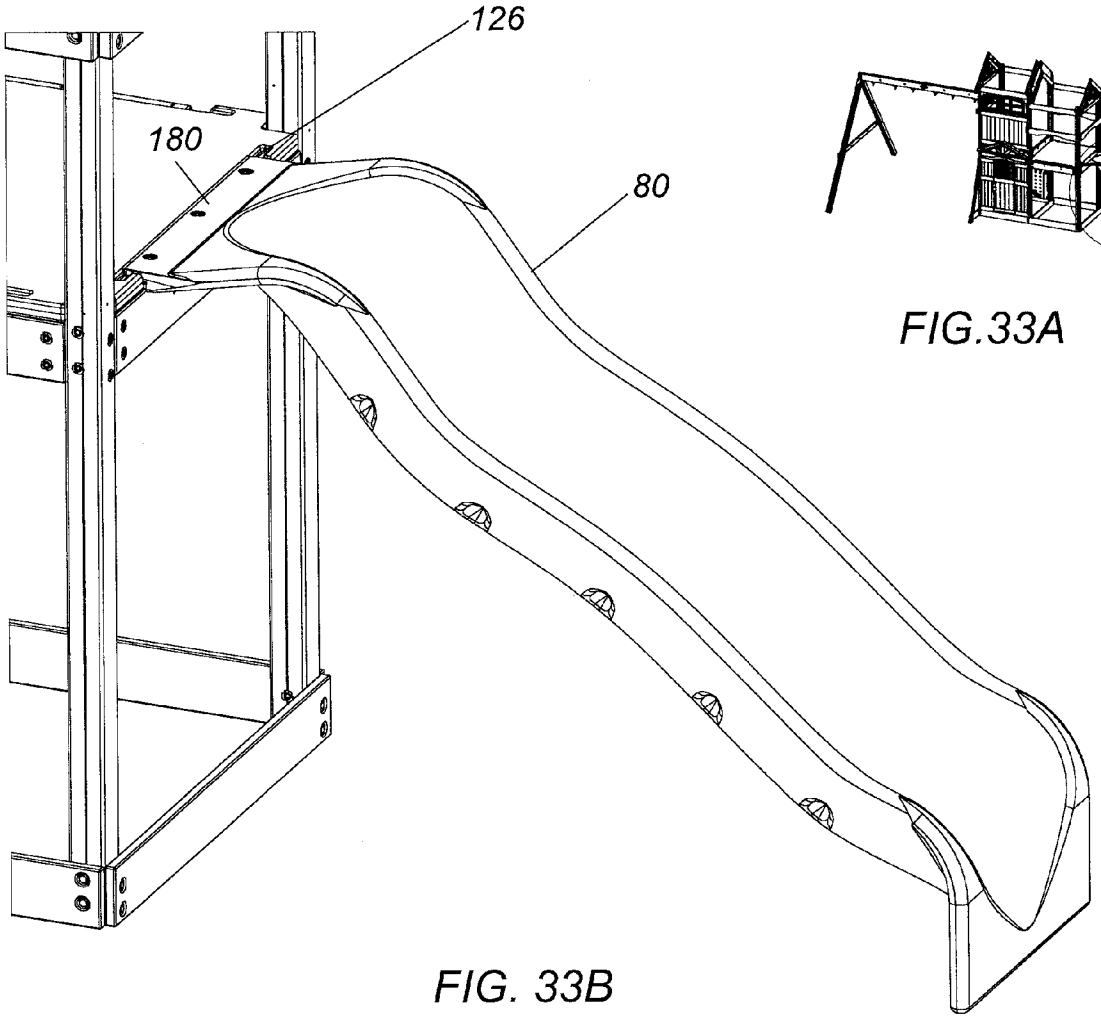
FIG. 33B is a view of the slide within area B in FIG. 33A.
Figure 34A:
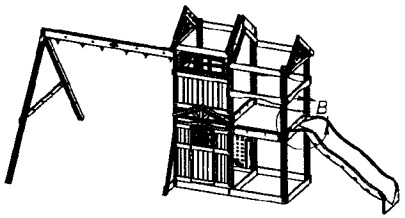
FIG. 34A is a front perspective view of the present invention.
Figure 34B:
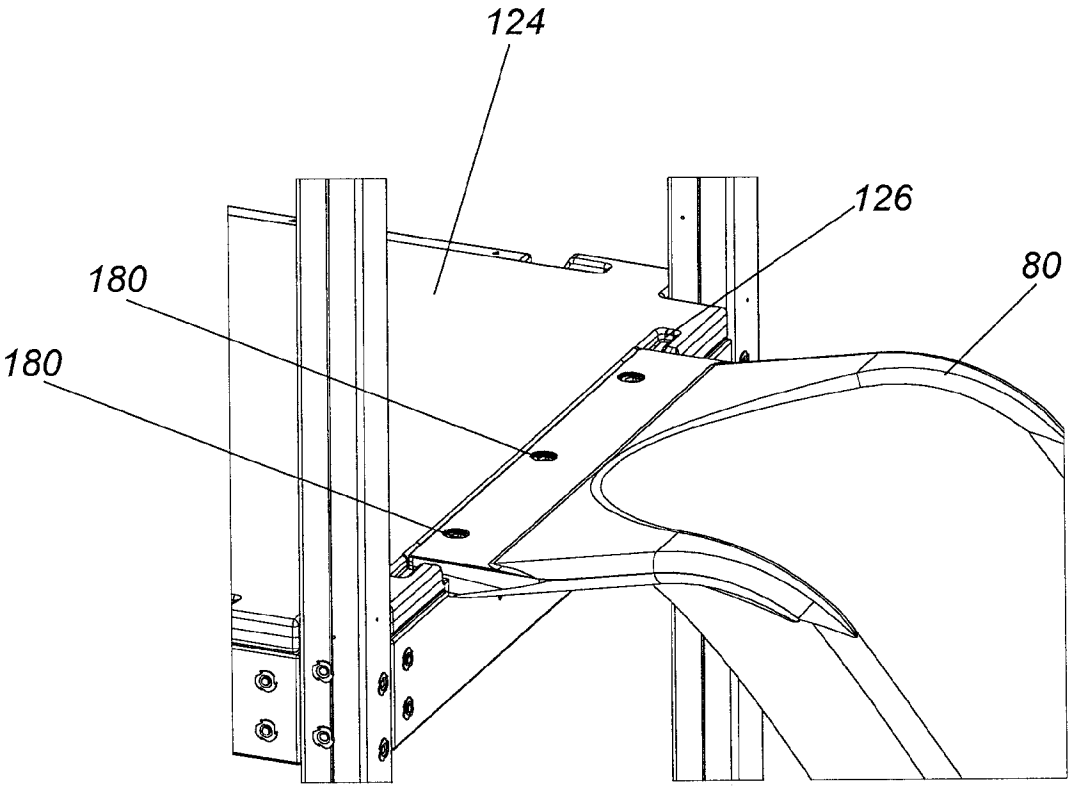
FIG. 34B is a view with area B in FIG. 34A.

The slide 80 is illustrated in detail in FIGS. 33B, and 34B. A single piece blow molded plastic slide 80 can also be secured to any of the three open sides of the lower tier 16. The slide 80 is secured to the tier 16 with fasteners 180 which fit into the apertures 126 of the floor panel 124. An enclosed tubular slide can also be employed.

Figure 35A:
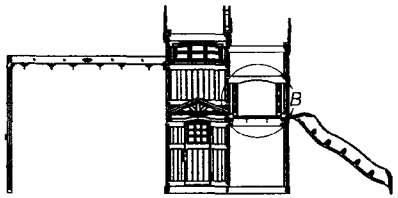
FIG. 35A is a front view of the present invention.
Figure 35B:
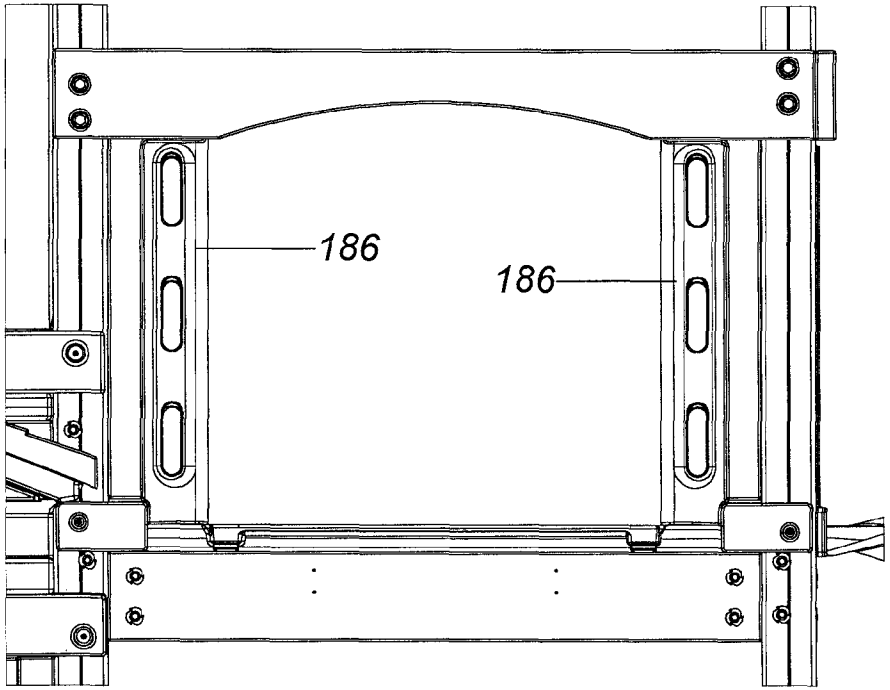
FIG. 35B is a view within area B in FIG. 35A.
Figure 36A:
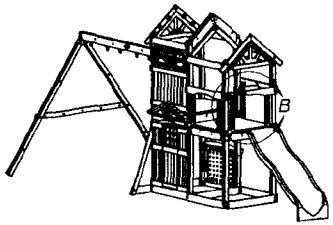
FIG. 36A is a front perspective view of the present invention.
Figure 36B:
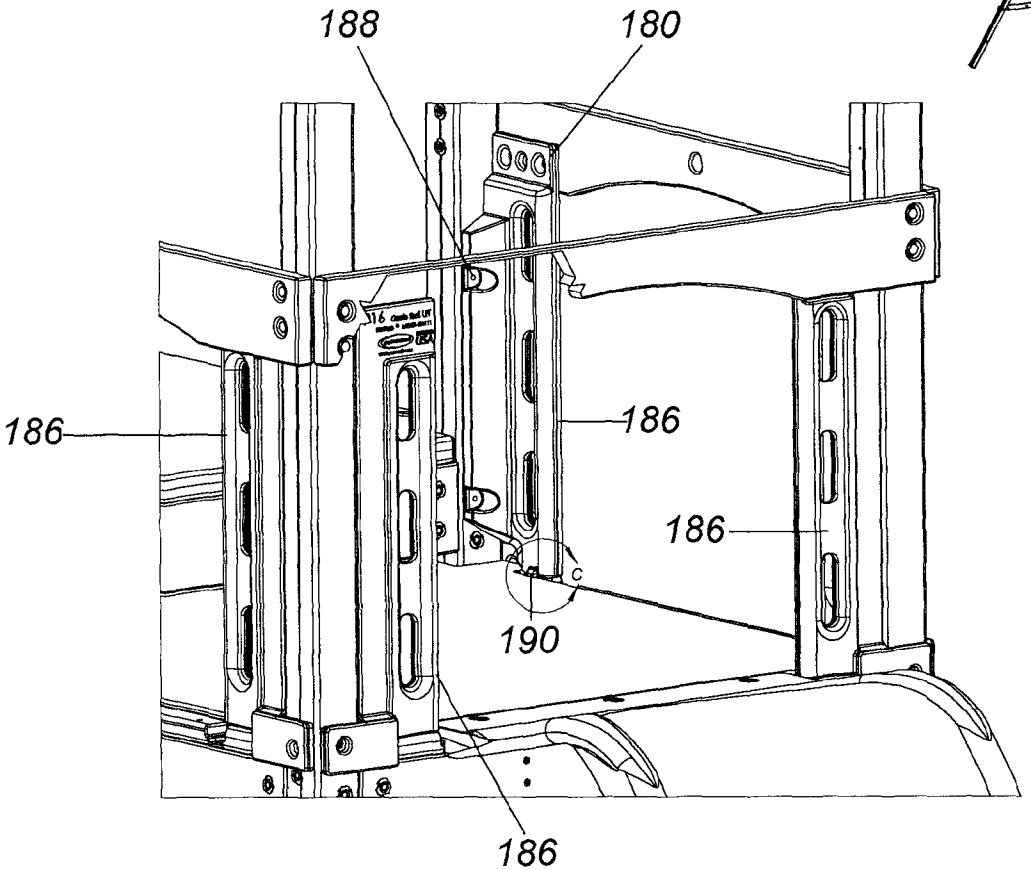
FIG. 36B is a view within area B in FIG. 36A.
Figure 36C:
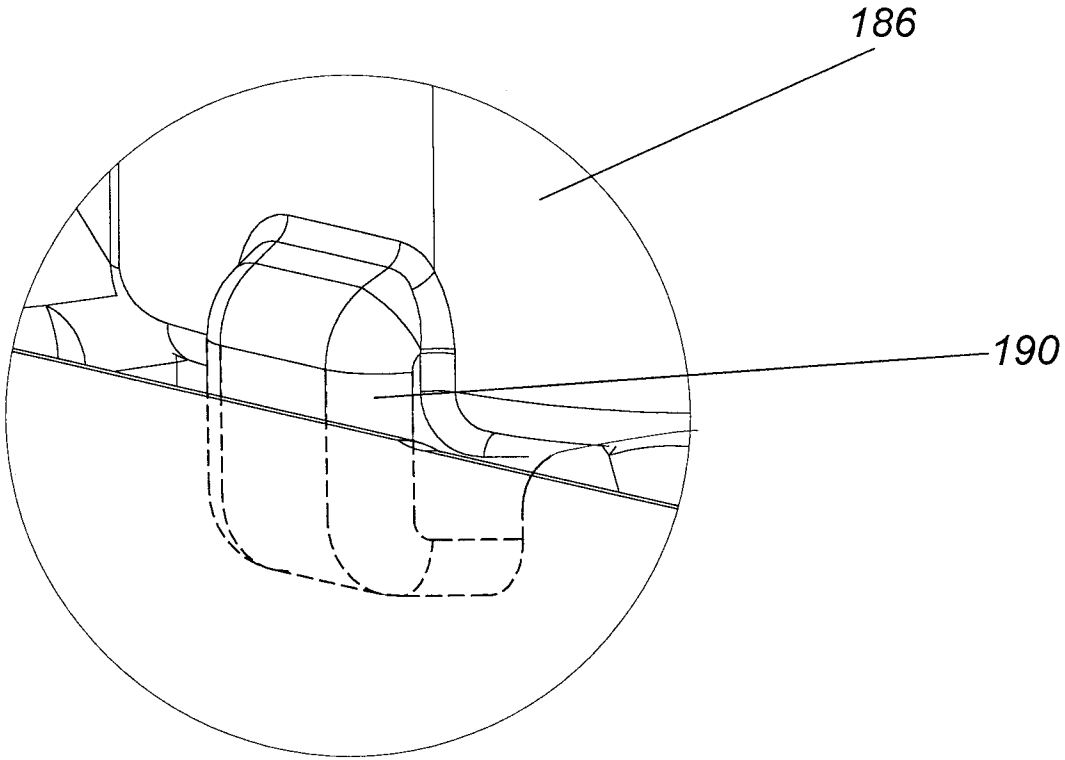
FIG. 36C is a view within area C in FIG. 36B.
Figures 37A, 37B:
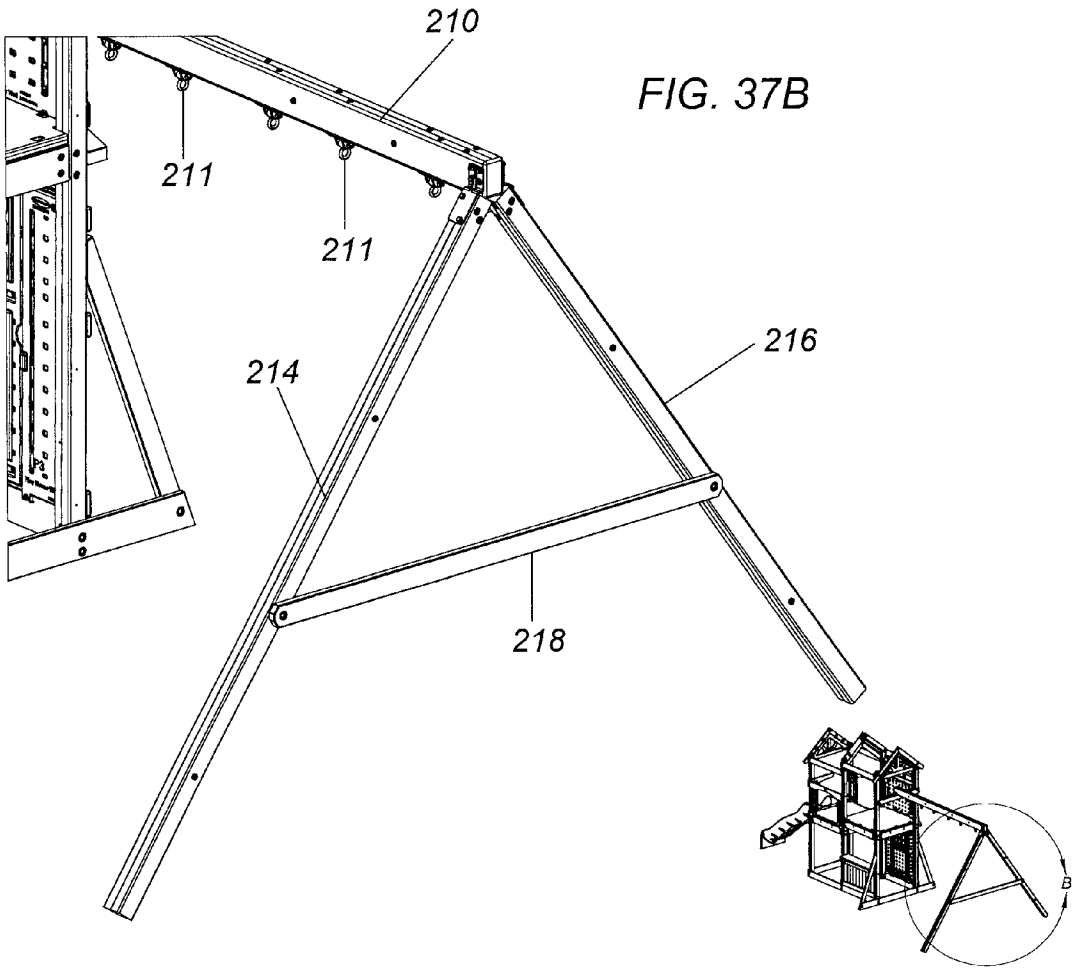
FIG. 37A is a rear perspective view of the present invention.
FIG. 37B is a view within area B in FIG. 37A.
Figure 38B:
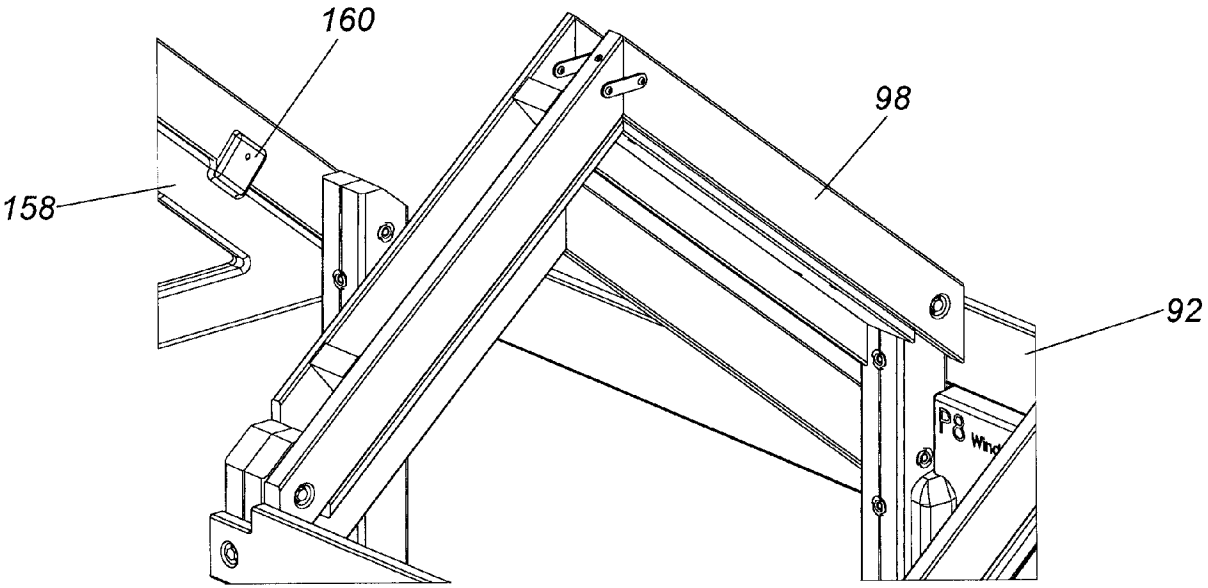
FIG. 38B is a view within area B in FIG. 38A.
Figure 38A:
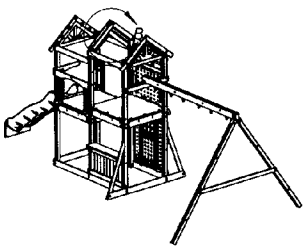
FIG. 38A is a rear perspective view of the present invention.

The upper level 18 is illustrated in detail in FIGS. 35B, 36B, and 36C. The upper level 18 of tier 16 has three openings. Each of the openings has grab rails 186 secured to the sides thereof, FIGS. 35B and 36B. As illustrated in FIG. 36B, the grab rail 186 is secured to both a post and a cross member with fasteners. The grab rails 186 include attachment devices 188, 190 (FIG. 36B) which assist in securing the grab rails to the posts and cross members. The grab rails also have a tab 190 molded to the bottom thereof, FIG. 36C. The tab engages a slot on the floor 124 to help secure the grab rail to the tier. The grab rails 186 and ladder sides 161 can alternatively be made of tubular steel.

The walls, windows and grab rails are all molded with features that provide for lag-screw attachment of these members to the outside of the posts adjacent to these members. Fastener heads throughout the play set are recessed to prevent the fastener heads from snagging on clothing or possibly causing other injury. While this type of fasteners is preferred, any other type of fasteners can also be employed.

Figure 42:
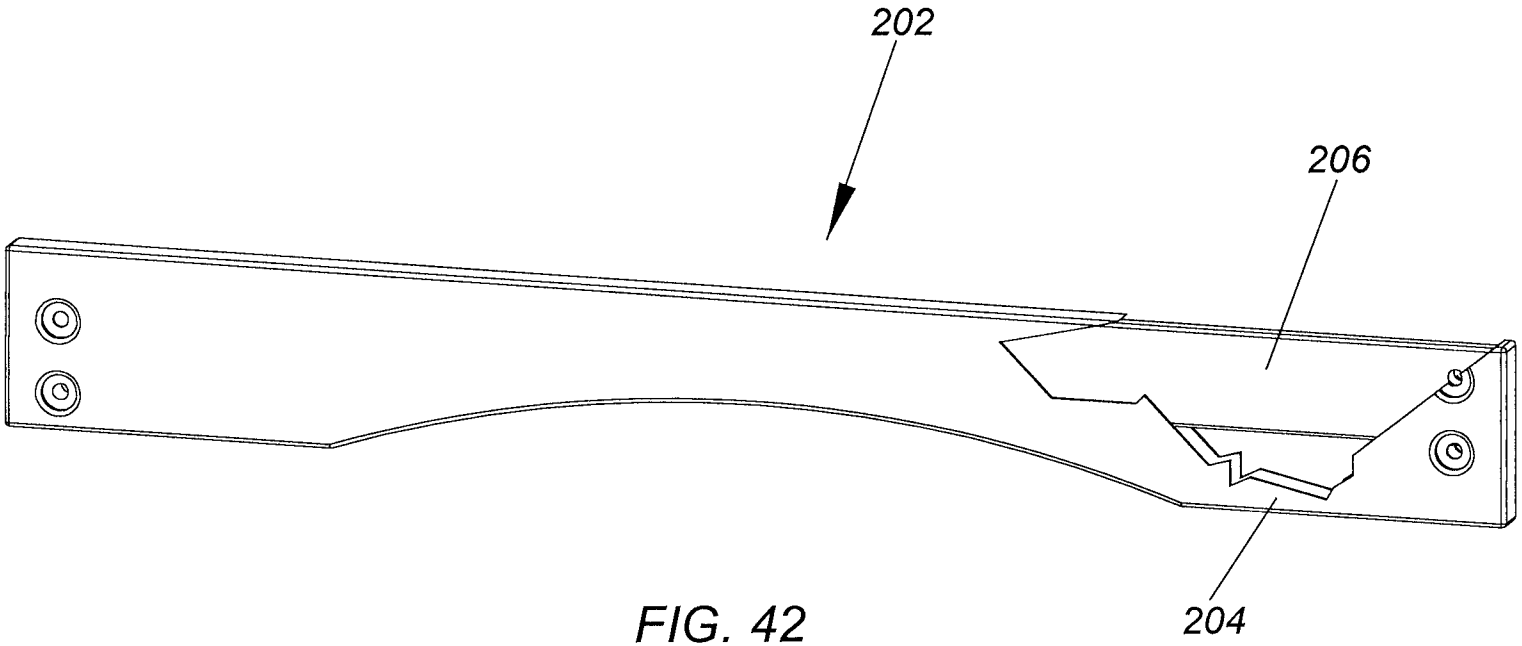
FIG. 42 is a view of a steel reinforced plastic component with a portion of the component broken away.
Figure 43:
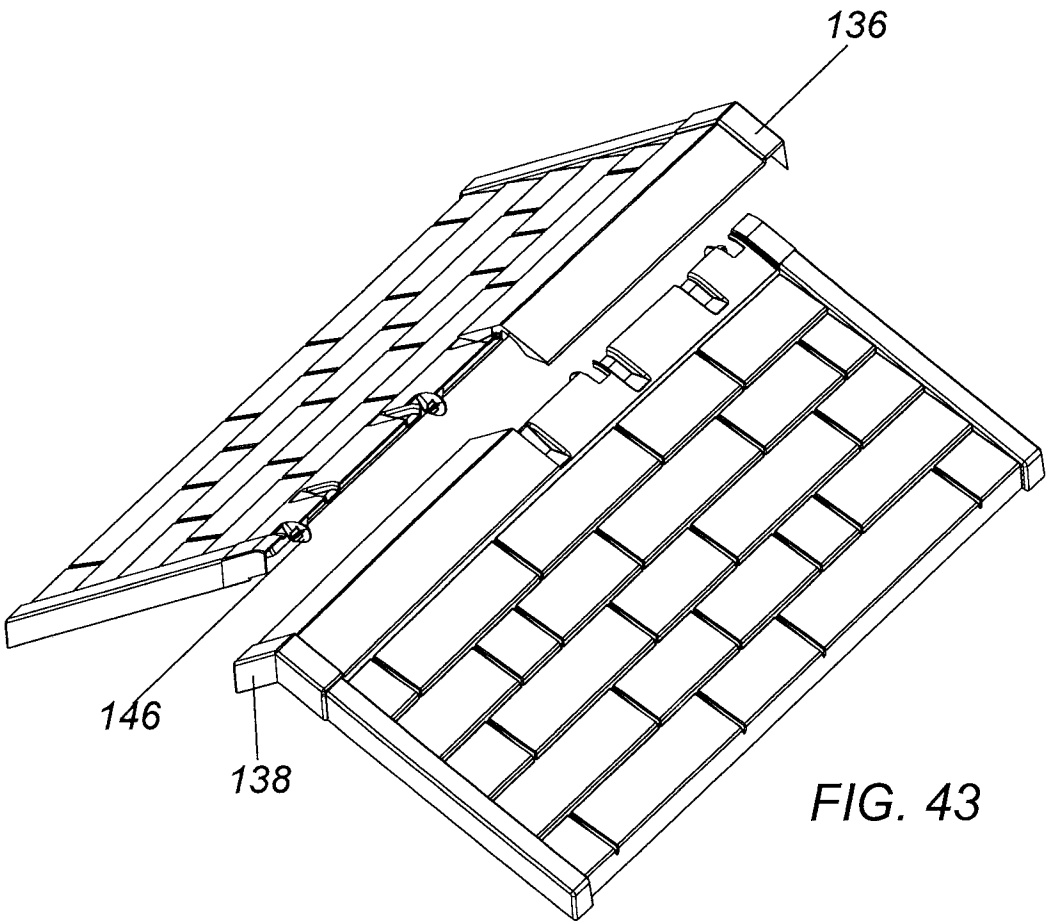
FIG. 43 is a view of a first embodiment of a roof structure.
Figure 44:
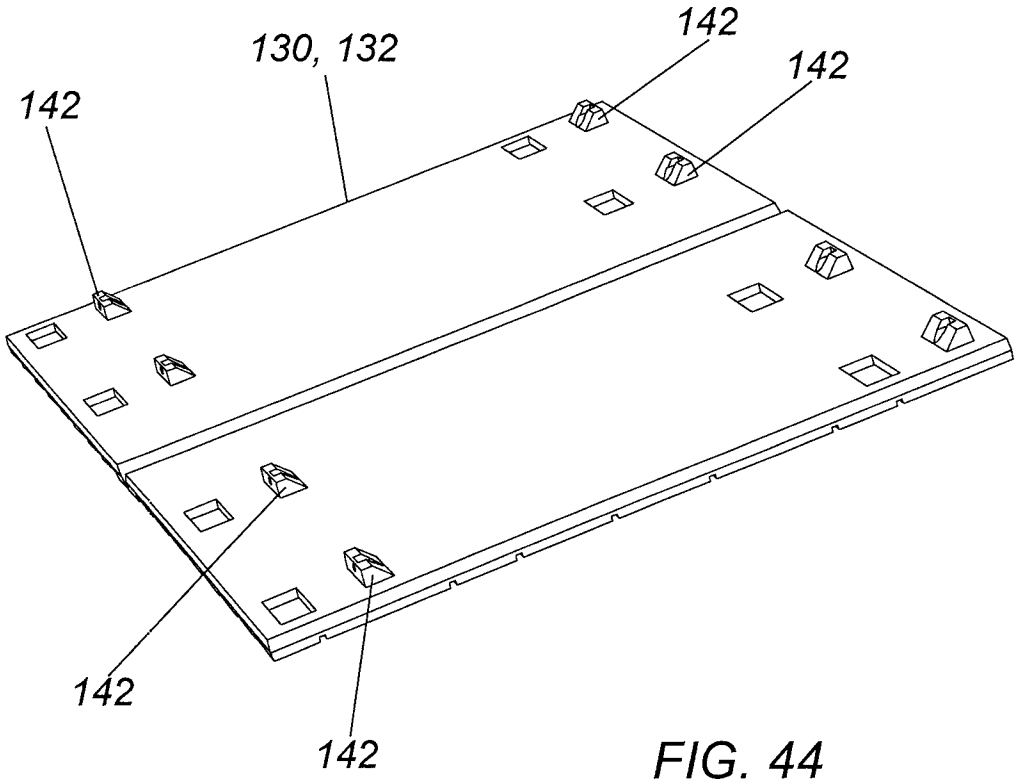
FIG. 44 is an underside view of an alternative embodiment of a roof structure.

A swing set 200 is secured at one end thereof to the upper level 20 of upper tier 14. The swing set 200 is illustrated in detail in FIGS. 12, 37B, 39B, and 40B. The swing set 200 is preferably made from wood for strength. However, the swing set 200 can also be made from reinforced blow molded plastic. An example of a reinforced blow molded plastic component is illustrated in FIG. 42. The outer shell 204 of the component 202 is made from blow molded plastic. The inner reinforcing member 206 is made from wood or metal. The outer shell 204 can be molded onto the inner reinforcing member 206 or they can be secured together by fasteners, glue, etc.

The swing set 200 includes a horizontal top bar or member 210. One end of the bar 210 is secured to the upper level 20 of upper tier 14. The opposite end of bar 210 is secured to a frame 212. The frame 212 preferably includes two upright members 214 and 216. Members 214 and 216 are secured to the bar 210 at one end of each of the members. The opposite end of each of the members 214 and 216 rest on the ground and provides support for the swing set 200. A cross member 218 is secured between members 214 and 216. Cross member 218 secures the members 214 and 216 together and helps to provides stability for the members 214, 216 and frame 212. A preferred embodiment of the swing set includes two swings and a trapeze with rings. The swings and trapeze are secured to bar 210 by chains and ring members 211. Any other type of swings, components, or elements can also be employed on the swing set.

Figure 39A:
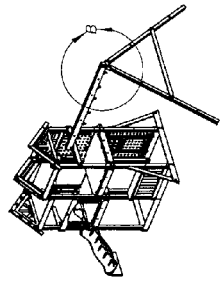
FIG. 39A is a rear perspective view of the present invention.
Figure 39B:
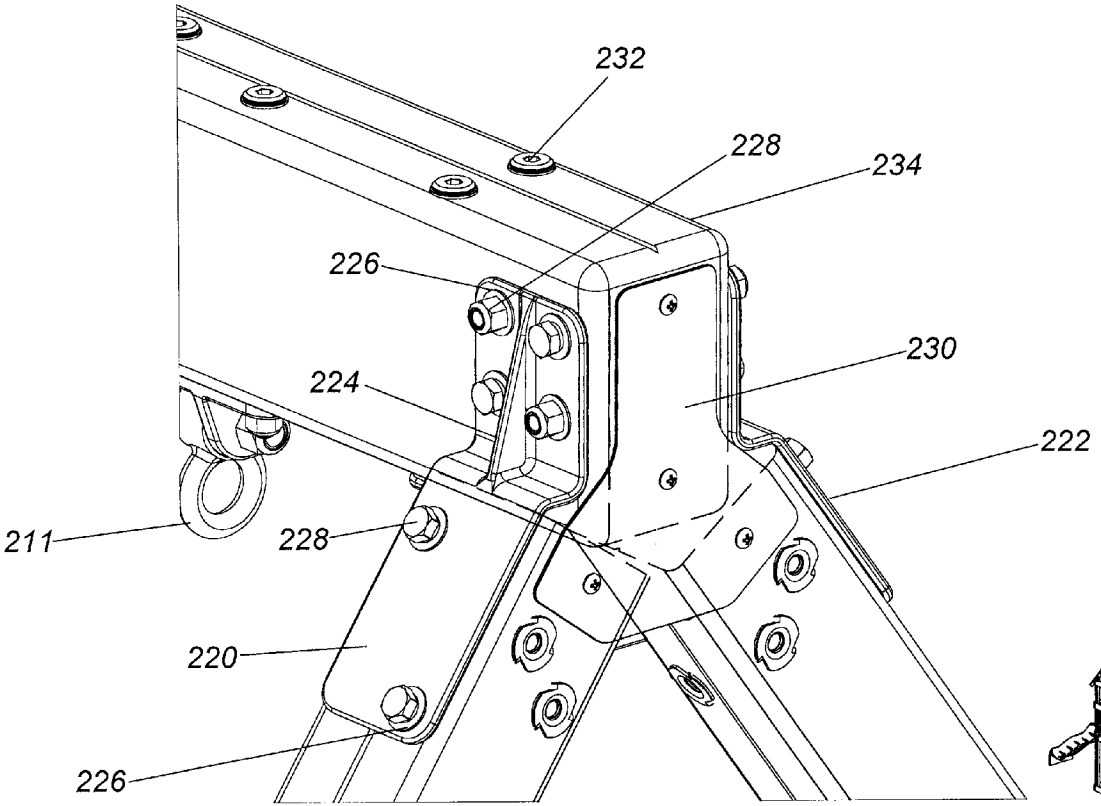
FIG. 39B is a view within area B in FIG. 39A.

FIG. 39B illustrates in detail how the members 214 and 216 are secured to bar 210. Plates 220 and 222 are formed at a predetermined angle which secures members 214 and 216 to bar 210 to provide maximum support for the swing set. The plates 220 and 222 also include a reinforcing brace member 224. The plates 220 and 222 include apertures 226 through which fasteners 228 are placed to secure the plates to the members 214, 216 and bar 210. While threaded fasteners are illustrated, any other type of fasteners can also be employed. An end plate 230 is secured to the ends of members 214, 216 and bar 210 to help secure these elements together, FIG. 39B. While screws are illustrated as securing plate 230 to elements 214, 216 and 210, any other type of fastener can also be employed. Fasteners 232 are illustrated on the top of bar 210. These fasteners are employed when a reinforcing member is employed with a blow molded plastic bar cover or member 234. Fasteners 232 secure the reinforcing member to the outer blow molded plastic cover or member 234.

Figure 40A:
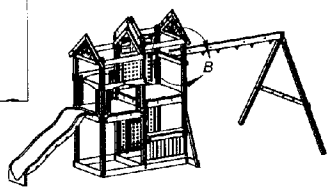
FIG. 40A is a rear perspective view of the present invention.
Figure 40B:
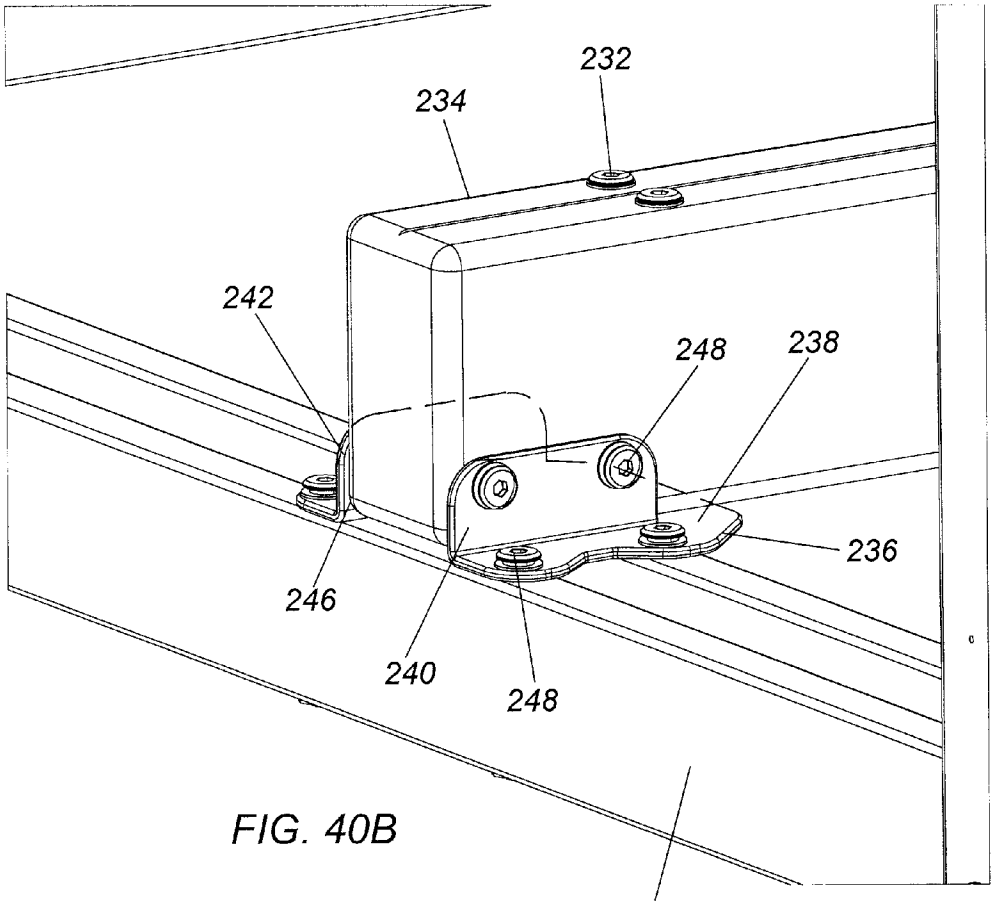
FIG. 40B is a view within area B in FIG. 40A.
Figure 41B:
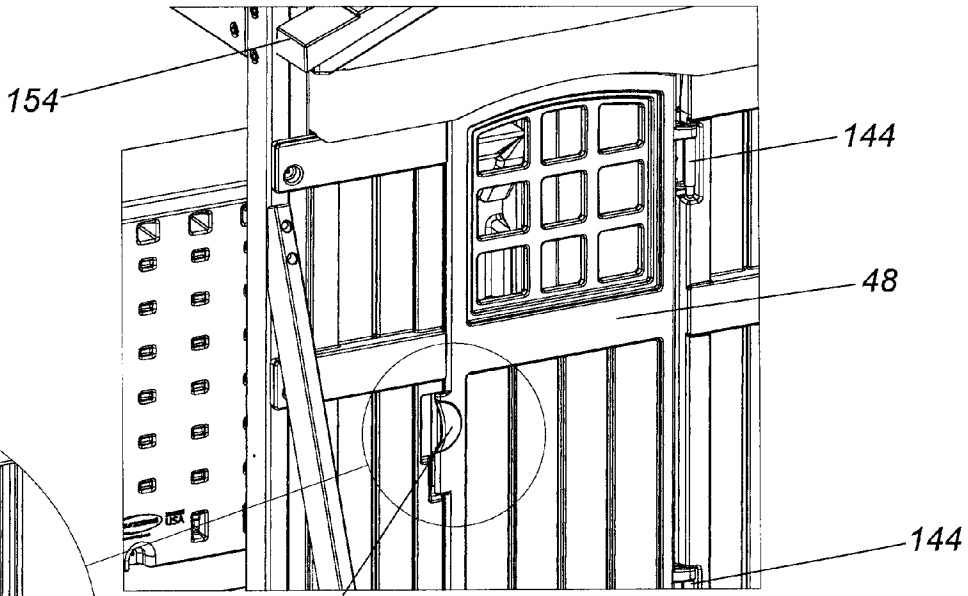
FIG. 41B is a view within area B in FIG. 41A.
Figure 41A:
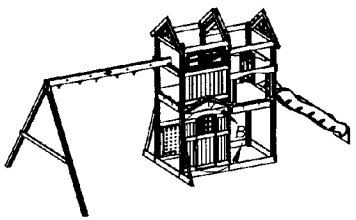
FIG. 41A is a front perspective view of the present invention.
Figure 41C:
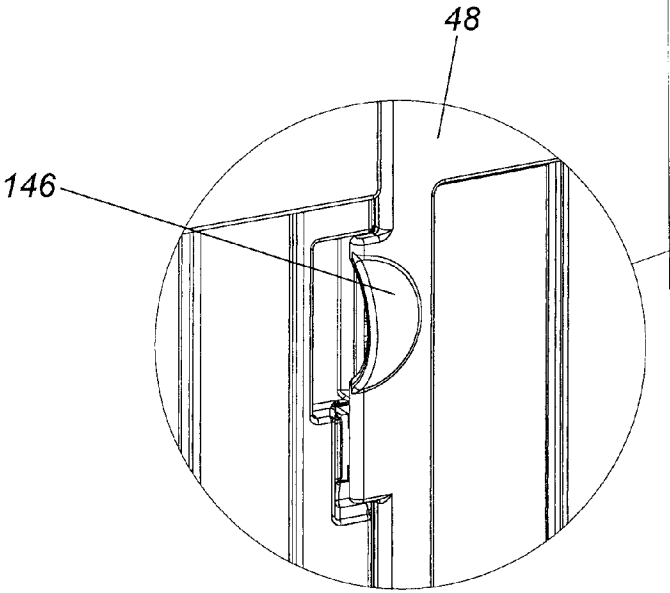
FIG. 41C is a view within the circled area in FIG. 41B.

An opposite end of bar 210 is secured to the upper level 20 of upper tier 14, as illustrated in FIG. 40B. Bracket 236 secures the bar 210 to the cross member 102 and member 109. In a preferred embodiment, the bracket 236 is formed as a single piece. The bracket has a horizontal portion 238, two vertical portions 240, 242, and a slot 246. Bar 210 fits between the vertical portions 240, 242 and into the slot 246. Fasteners 248 secure the bracket 236 to both the cross member 109 and the bar 210.

Additional safety and aesthetic considerations incorporated into the plastic blow molded panels and members are the same color throughout the wall thickness of the material, unlike surface treatments like paint or stain which will wear off over time. Weathered wood becomes very rough and can easily cause abrasions. The plastic panels have relative smooth surfaces which will not easily cause abrasion injuries. The wood components of the play set are made of weather resistant materials in the cedar/cypress family of woods. Alternatively, the frame can be made of pine varieties with finishes that simulate more exotic varieties of wood and provide properties preventing premature weathering. All wood framing is given a weather resistant finish to help mitigate the effects of moisture and sun. The swing set's frame has been designed to eliminate protrusions or wood or metal fasteners to reduce the risk of injury. All openings that would tend to attract nesting by birds or insects have been covered or eliminated. Extra support has been provided where the swing set bar is secured to the tower's upper level to insure a strong connection. Transition areas from the lower floor panel to the slide and the climbing wall have been carefully recessed to provide smoothly transitioning surfaces where the components are joined together. The play house door has an integrally molded handle with good ergonomic clearance for fingers, and the handle requires no assembly. All edges where frequent handling is expected are given additional treatment to provide a smooth surface. Alternative to the many panel fastening features is a configuration incorporating premounted tracks of metal or plastic onto the wood frame's mounting surfaces. In this configuration, the plastic panels slide into position within the mounted channels. An alternative design incorporates a tubular slide in place of, or in addition to, the conventional slide. The tubular slide is enclosed, and mounts to the floor panel surfaces where the other accessories attach, and to the main post in place of the grab rails at this mounting location.

While many of the components of the present invention are made from blow molded plastic alone, these components can also be made with a reinforcing member within the blow molded plastic. Wood and metal are the preferred reinforcing components. Further, while the preferred fasteners are disclosed as threaded and recessed, the fasteners can be of various other types, wood screw, bolt, friction fit, etc. The fasteners do not have to be recessed also.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A play set comprising:

a plurality of tiers, said tiers being secured together, each said tier having an upper level and a lower level, at least one of said upper level or said lower level being enclosed by a plurality of walls;

at least one of said upper level or said lower level having no walls and being open on all sides, said upper level including a floor panel said floor panel includes a plurality of features along a perimeter, said features enable said walls to be secured to said floor panel without the use of fasteners, an underside of said floor panels including a plurality of tack offs which provide reinforcement of said floor panel;

at least one of a slide, a ladder, and a climbing wall being secured to one of said upper level, said upper level to which said at least one said slide, said ladder and said climbing wall is secured being open on all sides;

at least one of said lower level having a play house;

all of said upper levels having a roof enclosing a top of said upper levels; and a swing set secured at one end to one of said tiers, an opposite end of said swing set having a frame which supports said swing set on a surface.

2. The play set of claim 1 wherein said walls, said roofs, said play house, said climbing wall, and said ladder are made from blow molded plastic.

3. The play set of claim 1 wherein said walls, said roofs, said play house, said climbing wall, and said ladder are made from blow molded plastic with a reinforcing member within said blow molded plastic.

4. The play set of claim 1 wherein each said tier includes a plurality of vertical posts, said posts extending from a surface upward to an upper portion of said tier; and a plurality of roof rafters secured between two of said posts, said roof rafters providing support for said roof.

5. The play set of claim 4 including a plurality of cross members secured between said posts, each said cross member being secured to at least two posts.

6. The play set of claim 5 wherein said cross members are secured to said posts at a lower end of said posts, at an intermediate height of said posts, and at an upper portion of said posts.

7. The play set of claim 6 including a plurality of floor joists secured to said cross members at an intermediate height of said posts; and a floor panel secured to both said cross members at an intermediate height of said posts and said floor joists.

8. The play set of claim 4 including at least one gable secured to said roof rafters.

9. The play set of claim 1 wherein said upper level to which said at least one said slide, said ladder, and said climbing wall is secured having grab rails adjacent said open side, said grab rails being secured to said posts.

10. The play set of claim 1 wherein said swing set is made from blow molded plastic with reinforcements therein, thereby preventing injures from rough wood surfaces and splinters from wood.

11. The play set of claim 1 including a plurality of windows secured to at least one of said upper levels.

12. The play set of claim 11 wherein openings of said windows are constructed and arranged to prevent children from crawling through said windows.

13. The play set of claim 1 wherein said play house includes a door on one side and a plurality of short walls on the remaining sides of said play house.

14. The play set of claim 13 wherein one of said short walls of said play house has a countertop secured to an upper side thereof.

15. The play set of claim 1 wherein said climbing wall includes a plurality of hand holds secured to an upper surface of said climbing wall, said hand holds are secured to said climbing wall with a plurality of removable fasteners.

16. The play set of claim 1 wherein said walls include at least one tab, said tab engaging said feature of said floor panel thereby securing said wall to said floor panel.

17. The play set of claim 1 where each said roof includes two roof sections secured to each other along one side of each of said roof sections by a living hinge.

18. The play set of claim 1 wherein said tiers are different heights.

19. The play set of claim 2 wherein said walls, said roofs, said play house, said climbing wall, and said ladder are made from blow molded plastic having different colors.

* * * * *